US011433981B2

(12) United States Patent
Chan et al.

(10) Patent No.: US 11,433,981 B2
(45) Date of Patent: Sep. 6, 2022

(54) ELECTRIC ACTUATOR FOR A MARINE STEERING SYSTEM, AND METHODS OF DEFINING STEERING BOUNDARIES AND DETERMINING DRIVE MECHANISM FAILURE THEREOF

(71) Applicant: Marine Canada Acquisition Inc., Richmond (CA)

(72) Inventors: Anson Chin Pang Chan, Richmond (CA); Geoffrey David Duddridge, Nanaimo (CA); Ian Michael Carlson, Nanaimo (CA); Richard Redfern, Chermains (CA); Mark Isaac Dyck, Chilliwack (CA)

(73) Assignee: Marine Canada Acquisition Inc., Richmond (CA)

( * ) Notice: Subject to any disclaimer, the term of this patent is extended or adjusted under 35 U.S.C. 154(b) by 388 days.

(21) Appl. No.: 16/788,684

(22) Filed: Feb. 12, 2020

(65) Prior Publication Data

US 2020/0255109 A1 Aug. 13, 2020

Related U.S. Application Data

(60) Provisional application No. 62/805,299, filed on Feb. 13, 2019.

(51) Int. Cl.
*B63H 20/12* (2006.01)
*B63B 79/40* (2020.01)
(Continued)

(52) U.S. Cl.
CPC ..... *B63H 20/12* (2013.01); *B63B 79/10* (2020.01); *B63B 79/40* (2020.01); *B63H 2020/003* (2013.01)

(58) Field of Classification Search
CPC .. B63H 20/12; B63H 2020/003; B63B 79/40; B63B 79/10
See application file for complete search history.

(56) References Cited

FOREIGN PATENT DOCUMENTS

CA 2516887 C * 3/2008 ..... B63H 21/213
JP 2020070015 A * 5/2020 ..... B63H 20/12
(Continued)

*Primary Examiner* — Stephen P Avila
(74) *Attorney, Agent, or Firm* — Berenato & White, LLC

(57) ABSTRACT

An electric actuator for a marine steering system comprises a housing and an output shaft reciprocatingly received by the housing. There is a rotor disposed within the housing. The rotor is coupled to the output shaft of the electric actuator. Rotation of the rotor causing the output shaft of the electric actuator to reciprocate relative to the housing. There is a motor disposed within the housing. The motor has an output shaft coupled to the rotor. A longitudinal axis of the output shaft of the motor is parallel with a longitudinal axis of the output shaft of the electric actuator. There is also a drive mechanism disposed within the housing. The drive mechanism couples the output shaft of electric actuator to the rotor. The drive mechanism is on a plane radial to a longitudinal axis of the output shaft of the motor. There is an actuator position sensor disposed on the rotor for sensing a position of the rotor. The actuator position sensor senses an actual steering position based on a position of the rotor. There is a motor position sensor disposed on the output shaft of the motor for sensing a rotating position of the motor. The motor position sensor senses a relative steering position based on a position of the motor.

28 Claims, 23 Drawing Sheets

(51) Int. Cl.
*B63B 79/10* (2020.01)
*B63H 20/00* (2006.01)

(56) References Cited

FOREIGN PATENT DOCUMENTS

WO WO2016004532 A1 1/2016
WO WO-2020147967 A1 * 7/2020 ..... B63H 25/24

* cited by examiner

ELECTRIC ACTUATOR FOR A MARINE STEERING SYSTEM, AND METHODS OF DEFINING STEERING BOUNDARIES AND DETERMINING DRIVE MECHANISM FAILURE THEREOF

BACKGROUND OF THE INVENTION

Field of the Invention

The present invention relates to an electric actuator and, in particular, to an electric actuator for a marine steering system, and methods of defining steering boundaries and determining drive mechanism failure thereof.

Description of the Related Art

International Patent Application Publication No. WO/2016/004532 which was published on Jan. 14, 2016, in the name of Davidson et al., and the full disclosure of which is incorporated herein by reference, discloses a marine steering system comprising a propulsion unit including a tilt tube, a support rod received by the tilt tube, a tiller, and an electric actuator for imparting steering movement to the propulsion unit. The electric actuator includes a housing and an output shaft reciprocatingly received by the housing. The output shaft is partially threaded and has smooth surfaces. There is a motor disposed within the housing. The motor includes a stator and a rotor. Rotation of the rotor causes the output shaft to translate axially relative to the rotor and causes the output shaft to reciprocate relative to the housing. A pivot plate is pivotably connected to the tiller of the propulsion unit. The pivot plate rotationally constrains the housing of the electric actuator to provide reaction torque for rotation of the rotor. There are support arms which connect respective ends of the output shaft to the support rod of the propulsion unit. The support arms provide rotational constraint to the output shaft and the support arms inhibit axial movement of the output shaft relative to the marine vessel while the housing of the electric actuator reciprocates linearly along the output shaft.

SUMMARY OF THE INVENTION

There is provided an electric actuator for a marine steering system. The electric actuator comprises a housing and an output shaft reciprocatingly received by the housing. There is a rotor disposed within the housing. The rotor is coupled to the output shaft of the electric actuator. Rotation of the rotor causes the output shaft of the electric actuator to reciprocate relative to the housing. There is a motor disposed within the housing. The motor has an output shaft coupled to the rotor. A longitudinal axis of the output shaft of the motor is parallel with a longitudinal axis of the output shaft of the electric actuator. There is also a drive mechanism disposed within the housing. The drive mechanism couples the output shaft of electric actuator to the rotor. The drive mechanism is on a plane radial to a longitudinal axis of the output shaft of the motor. There is an actuator position sensor disposed on the rotor for sensing a position of the rotor. The actuator position sensor senses an actual steering position based on a position of the rotor. There is a motor position sensor disposed on the output shaft of the motor for sensing a rotating position of the motor. The motor position sensor senses a relative steering position based on a position of the motor.

The drive mechanism may be a tensioned drive mechanism. The drive mechanism may include a belt which couples the output shaft of the electric actuator to the rotor. The belt may be provided with a tensioner. The drive mechanism includes an idler gear which couples the output shaft of the electric actuator to the rotor. Wiring may be connected to the electric actuator along a longitudinal axis which is generally parallel to the longitudinal axis of the output shaft of the electric actuator.

The actuator position sensor may be a rotary position sensor. The actuator position sensor may be a rotary position sensor that employs a gear reduction. The actuator position sensor may be a rotary position sensor that employs a gear reduction so that a driven sensor gear never rotates more than one rotation. The motor position sensor may be a rotary position sensor. The actuator position sensor may be disposed along the longitudinal axis of the output shaft of the electric actuator. The motor position sensor may be disposed along longitudinal axis of the output shaft of the motor.

The electric actuator may include a clutch directly coupled to the rotor. The clutch may function as a brake. The electric actuator may include a housing having a T-shaped profile with longitudinally extending arm portions.

There is also provided a steering system for a marine vessel. The steering system comprises a propulsion unit including a tilt tube, a support rod received by the tilt tube, a tiller, and an electric actuator. The electric actuator comprises a housing and an output shaft reciprocatingly received by the housing. There is a rotor disposed within the housing. The rotor is coupled to the output shaft of the electric actuator. Rotation of the rotor causing the output shaft of the electric actuator to reciprocate relative to the housing. There is a motor disposed within the housing. The motor has an output shaft coupled to the rotor. A longitudinal axis of the output shaft of the motor is parallel with a longitudinal axis of the output shaft of the electric actuator. There is also a drive mechanism disposed within the housing. The drive mechanism couples the output shaft of electric actuator to the rotor. The drive mechanism is on a plane radial to a longitudinal axis of the output shaft of the motor. There is an actuator position sensor disposed on the rotor for sensing a position of the rotor. The actuator position sensor senses an actual steering position based on a position of the rotor. There is a motor position sensor disposed on the output shaft of the motor for sensing a rotating position of the motor. The motor position sensor senses a relative steering position based on a position of the motor. There is a pivot plate is pivotably connected to the tiller of the propulsion unit. The pivot plate rotationally constrains the housing of the electric actuator to provide reaction torque for rotation of the rotor. Support arms connect respective ends of the output shaft to the support rod of the propulsion unit. The support arms provide rotational constraint to the output shaft and the support arms inhibiting axial movement of the output shaft relative to the marine vessel while the housing of the electric actuator reciprocates linearly along the output shaft. The motor of the electric actuator is disposed, relative to the marine vessel, in front of the output shaft of the electric actuator in the tilted down position and the tilted up position.

The electric actuator may be disposed under an engine pan of the propulsion unit and above a splashwell of the marine vessel in the tilted down position and the tilted up position. The housing of the electric actuator may be pivotable when the propulsion unit is pivotable. The housing may have a T-shaped profile with longitudinally extending arm portions, wherein one of the longitudinal extending arm portions overlaps a respective one of the support arms when the electric actuator strokes to a hard over position.

There is further provided a method of calibrating a steering range of an actuator of a propulsion unit for a marine vessel. The method includes mechanically coupling a output shaft of the actuator to support arms, which define hard stops, prior to mounting the actuator on the propulsion unit. The steering range of the actuator is pre-calibrated, while the output shaft of the actuator is coupled to the support arms, prior to mounting the actuator on the propulsion unit. The actuator is then mounted on the propulsion unit and an initial installation calibration protocol is initialized. The steering range of the actuator is then calibrated. Calibrating the steering range of the actuator includes calibrating ranges of a plurality of actuators. The actuator may be an electric actuator or a hydraulic actuator or any other type of actuator with a calibrated steering range.

There is still further provided a method of detecting drive mechanism failure in an electric actuator of a propulsion unit for a marine vessel. The actuator is provided with a rotor and rotation of the rotor causes an output shaft of the electric actuator to reciprocate. The actuator is also provided with a motor having an output shaft and a drive mechanism coupling the output shaft of the motor to the rotor. The actuator is further provided with an actuator position sensor which senses an actual steering position, and the actuator is provided with a motor position sensor which senses a relative steering position based on a position of the motor. The method includes comparing an actuator position sensor signal and a motor position signal to determine drive mechanism failure. The method may include providing the actuator position sensor along the longitudinal axis of the output shaft of the electric actuator, and providing the motor position sensor along the output shaft of the motor for sensing a rotating position of the motor, wherein a longitudinal axis of the output shaft of the actuator is parallel with a longitudinal axis of the output shaft of the motor. The method may include providing motorized repositioning of the electric actuator when drive failure mechanism is determined. The method may include providing manual repositioning of the electric actuator when drive failure mechanism is determined.

A method of defining a steering boundary of an actuator of a propulsion unit mounted on a marine vessel having plurality of propulsion units with each propulsion unit having a respective actuator. The method comprises determining if a sensor of an adjacent actuator has failed, and using a last known position of the adjacent actuator to define a steering boundary of allowable steering of the actuator to avoid propulsion unit collision.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
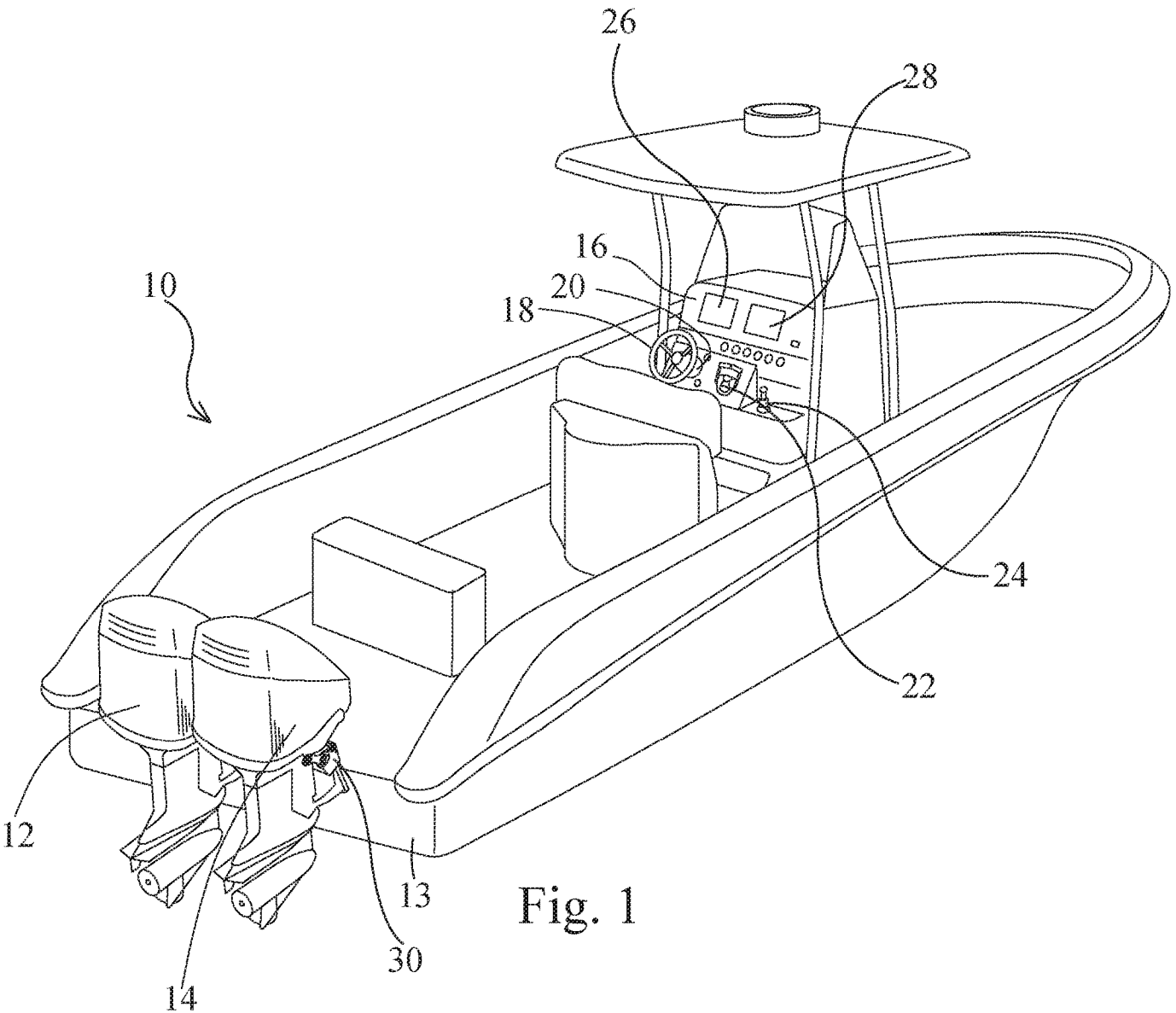
FIG. 1 is a perspective view of a marine vessel provided with a propulsion unit having an electric actuator.

Referring to the drawings and first to FIG. 1, there is shown a marine vessel 10 which is provided with a plurality of propulsion units which, in this example, are in the form of two outboard engines. The vessel includes a port propulsion unit 12 and a starboard propulsion unit 14 mounted to a transom 13 of the vessel. However, in other examples, the propulsion units may be any number or form of propulsion units. The marine vessel 10 is also provided with a control station 16 that supports a steering wheel 18 mounted on a helm 20, a control head 22, and a joystick 24. The control station 16 is conventional and allows the port propulsion unit 12 and the starboard propulsion unit 14 to be steered using either the steering wheel 18 and the helm 20 or the joystick 24 as disclosed in PCT International Application Publication Number WO 2013/1123208 A1 which is incorporated herein by reference. The control station 16 further includes a first display interface 26 and a second display interface 28. In this example, the first display interface is a SIMRAD® display interface which displays navigational information and the second display interface is a BEP® display which displays onboard system information.

Figure 2:
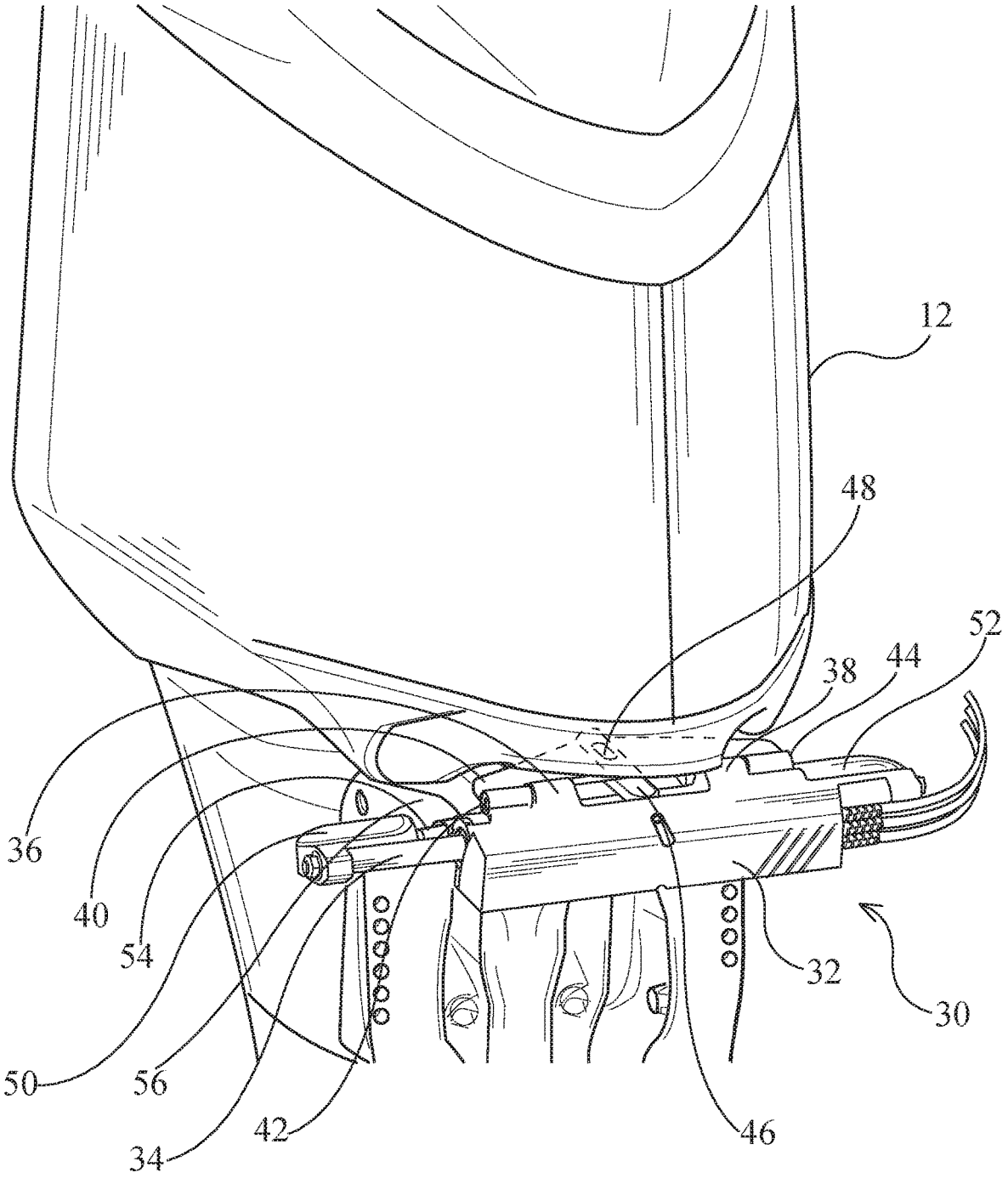
FIG. 2 is a perspective view of the propulsion unit and the electric actuator.

The port propulsion unit 12 of the marine vessel 10 is shown in greater detail in FIG. 2. The port propulsion unit 12 is provided with an electric actuator 30. The electric actuator 30 generally comprises a housing 32 with an output shaft 34 reciprocatingly received therein and spaced-apart housing arms 36 and 38 which extend radially outward of the housing 32. A pivot plate 40 can be coupled to each of the housing arms 36 and 38 by respective pivot pins 42 and 44. The pivot plate 40 extends between the housing arms 36 and 38. The pivot plate 40 can pivot about the pivot pins 42 and 44. A steering member or tiller 46 of the port propulsion unit 12 can be pivotably coupled to the pivot plate 40 by a tiller pin 48. There are support arms 50 and 52 which connect respective ends of the output shaft 34 of the electric actuator 30 to a support rod 54 and a tilt tube 56 of the port propulsion unit 12. The support arms 50 and 52 inhibit axial and rotational movement of the output shaft 34 of the electric actuator 30 relative to the marine vessel 10 while the housing 32 of the electric actuator 30 reciprocates along the output shaft 34 and linearly relative to the marine vessel 10. This relative linear movement of the housing 32 causes the tiller 46 of the port propulsion unit 12 to pivot and thereby cause the port propulsion unit to be steered in a conventional manner. It will be understood by a person skilled in the art that the starboard propulsion unit 14 has a substantially identical structure and functions in a substantially similar manner. The starboard propulsion unit is accordingly not described in detail herein.

Figure 3:
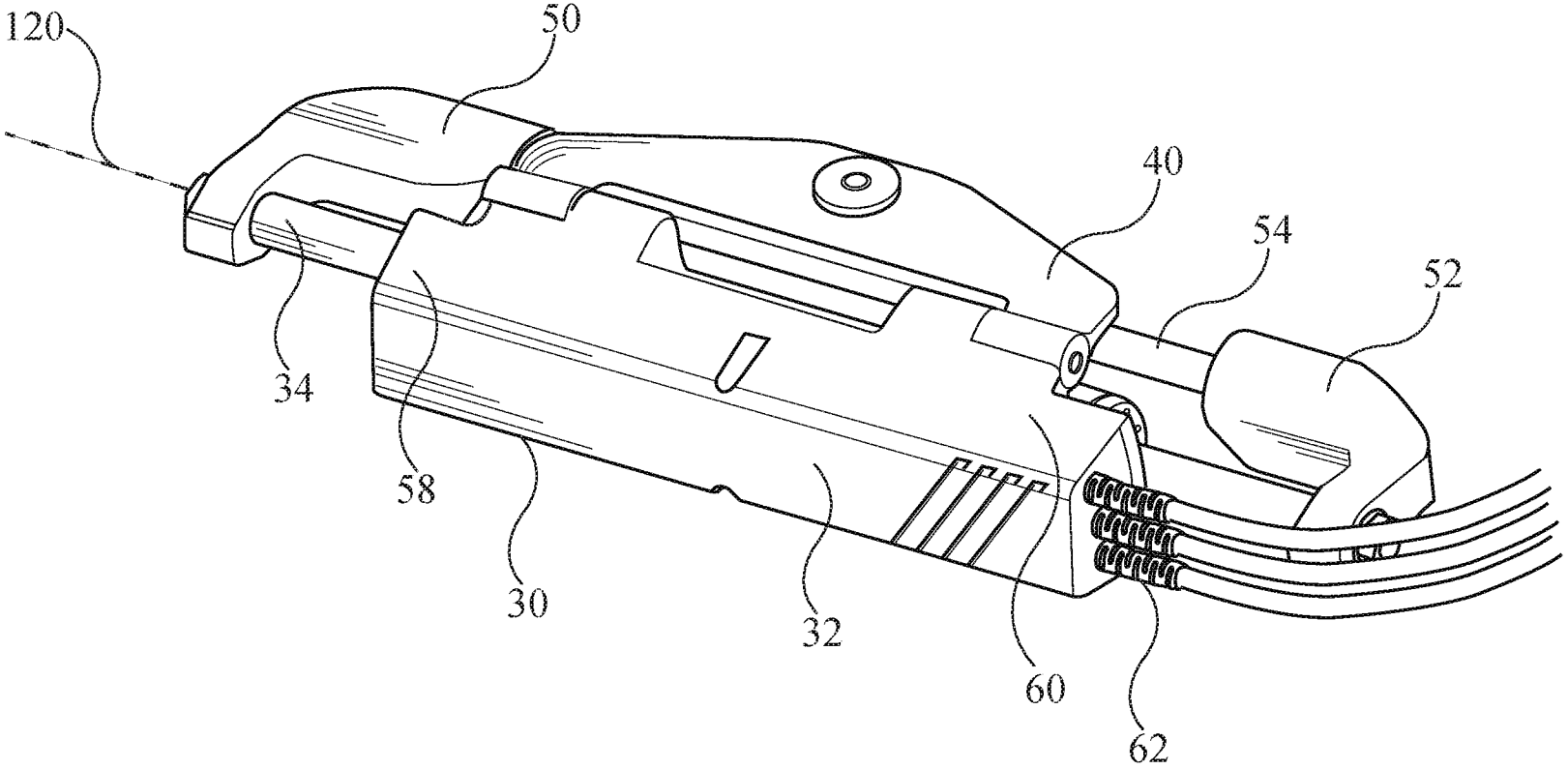
FIG. 3 is a perspective view of the electric actuator.
Figure 4:
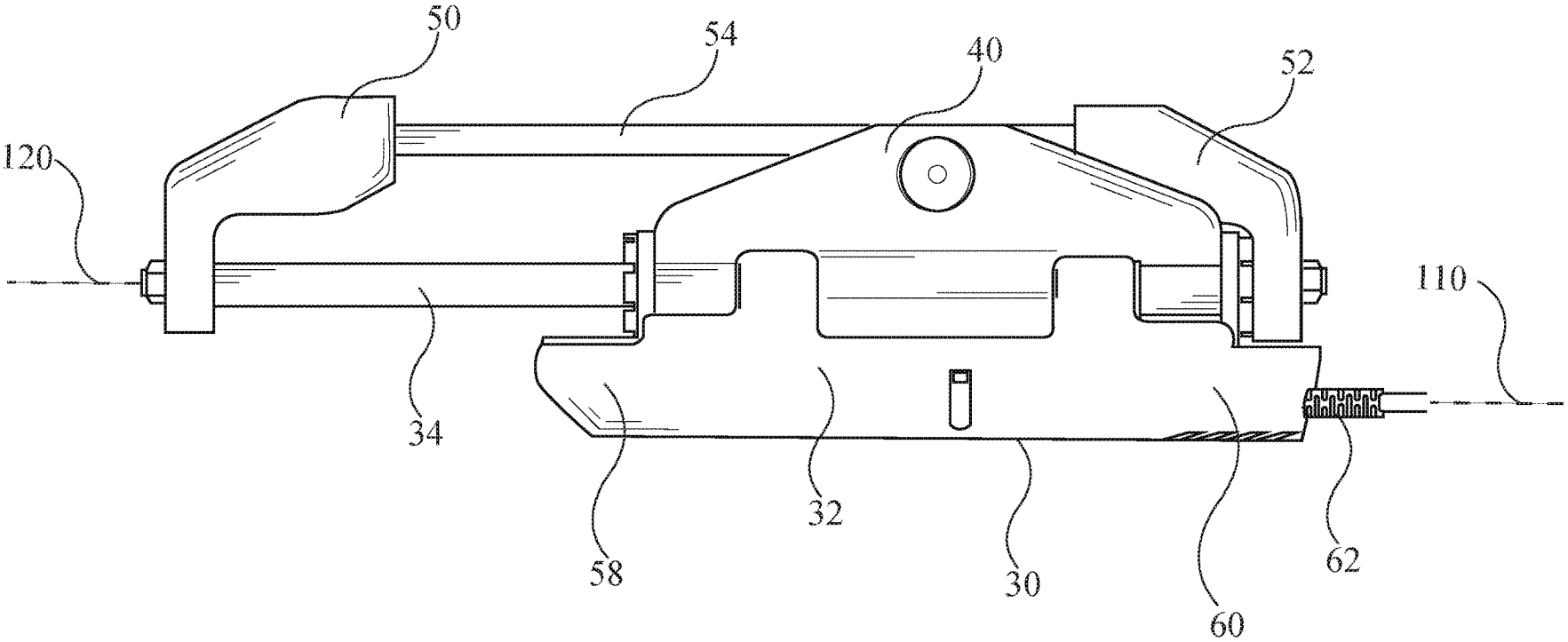
FIG. 4 is a top plan view of the electric actuator.

The electric actuator 30 is shown in greater detail in FIG. 3. The housing 32 of the electric actuator 30 has a T-shaped profile with longitudinally extending arm portions 58 and 60. The longitudinally extending arm portions 58 and 60 of the housing 32 extend longitudinally overlapping the support arms 50 and 52 when the electric actuator 30 strokes to hard over positions, as shown in FIG. 4, for the longitudinally extending arm portion 60 and the support arm 52. Wiring 62 is connected to the housing 32 of the electric actuator 30 at the longitudinally extending arm portion 60 along a longitudinal axis 110 which is generally parallel to a longitudinal axis 120 of the output shaft 34 of the electric actuator 30. This may offer advantages in clearance.

Figure 5:
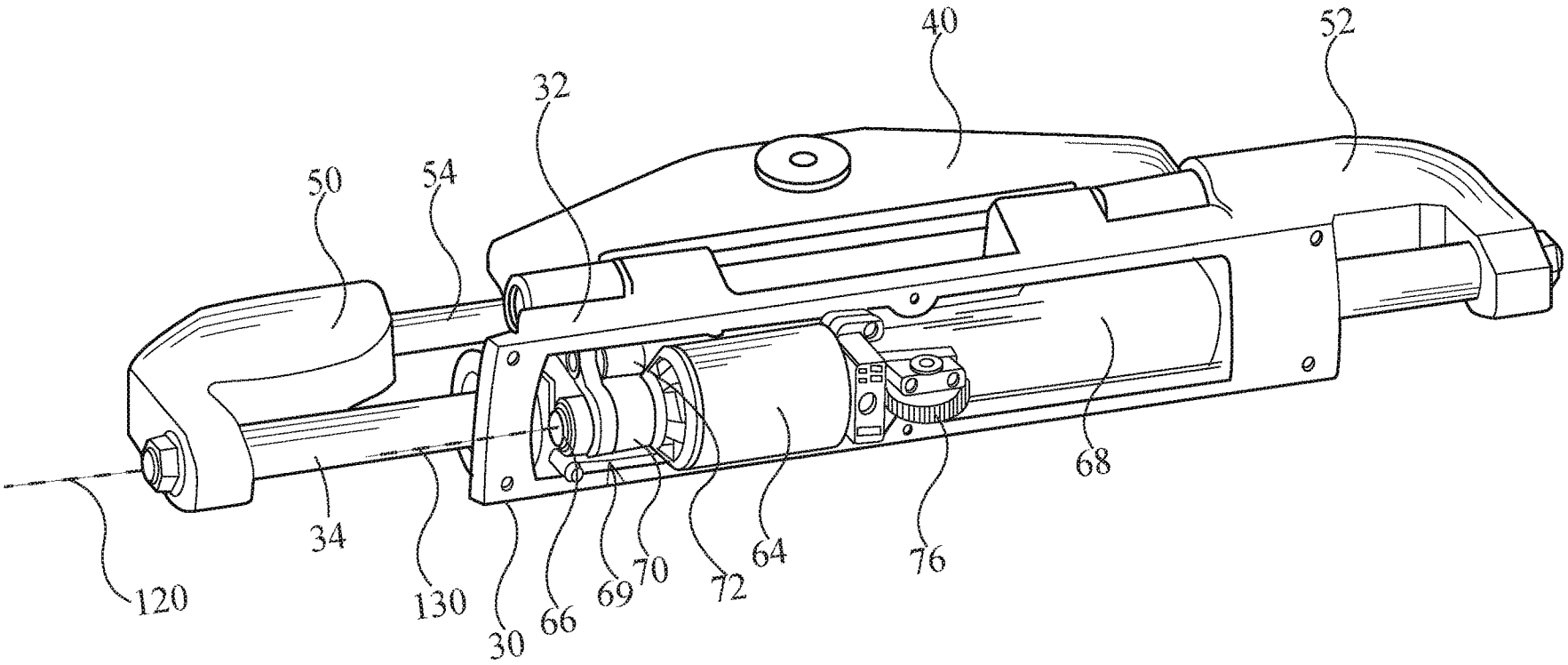
FIG. 5 is a partly broken away view of the electric actuator.
Figure 7:
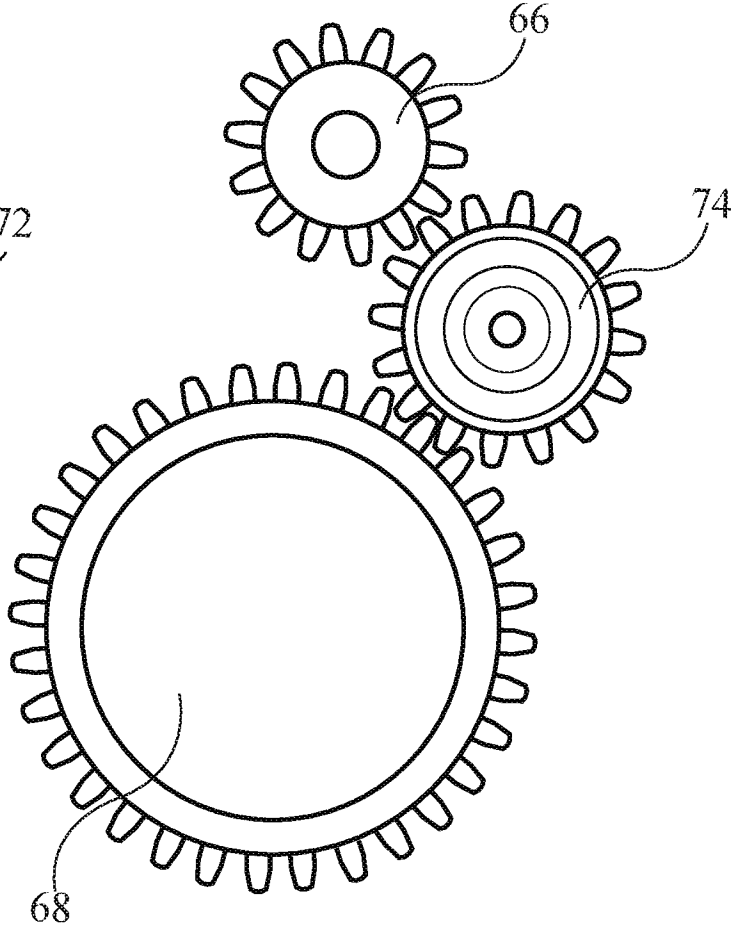
FIG. 7 is a schematic view showing an idler gear coupling an output shaft of a motor of the electric actuator to a rotor of the electric actuator.
Figure 6:
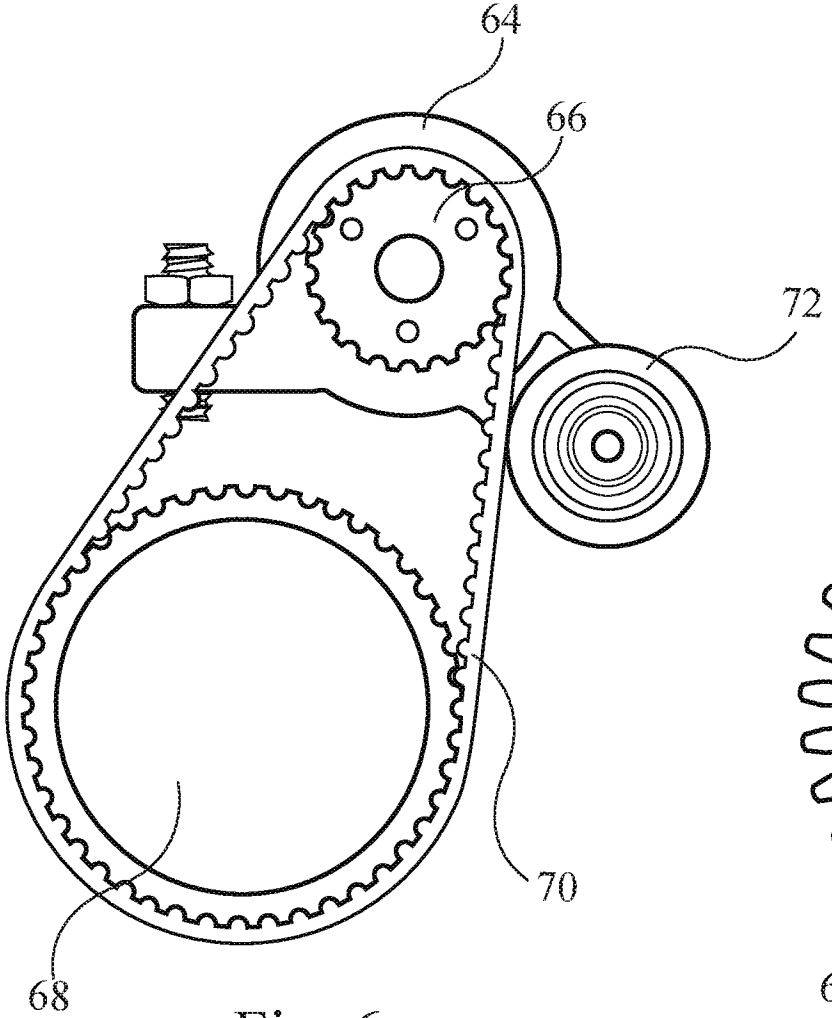
FIG. 6 is a schematic view showing a belt coupling an output shaft of a motor of the electric actuator to a rotor of the electric actuator.

FIG. 5 shows a partly broken away view of the electric actuator 30. A motor 64 of the electric actuator 30 is disposed such that an output shaft 66 of the motor 64 has a longitudinal axis 130 which is generally parallel to the longitudinal axis 120 of the output shaft 34 of the electric actuator 30. The longitudinal axis 120 of the output shaft 34 of the electric actuator 30 and the longitudinal axis 130 of the output shaft 66 of the motor 64 are orthogonal to a longitudinal axis of the marine vessel 10. In this example, the output shaft 66 of the motor 64 is coupled to a rotor 68 of the electric actuator 30 by a drive mechanism, in this example a gear train drive mechanism 69 that includes a belt 70, as best shown in FIG. 6, in order to transmit rotational motion from the output shaft 66 of the motor 64 to a rotor 68 of the electric actuator 30. In this example, the belt 70 is provided with a tensioner 72. Use of the belt 70 to couple the output shaft 66 of the motor 64 to the rotor 68 of the electric actuator 30 may dampen out the load impulses from the port propulsion unit 12. However, in other examples, the drive mechanism may employ other means such as an idler gear 74, shown in FIG. 7, to couple the output shaft 66 of the motor 64 to the rotor 68 of the electric actuator 30. The drive mechanism is on a plane radial to the longitudinal axis 120 of the output shaft 34 of the electric actuator 30.

Figure 8:
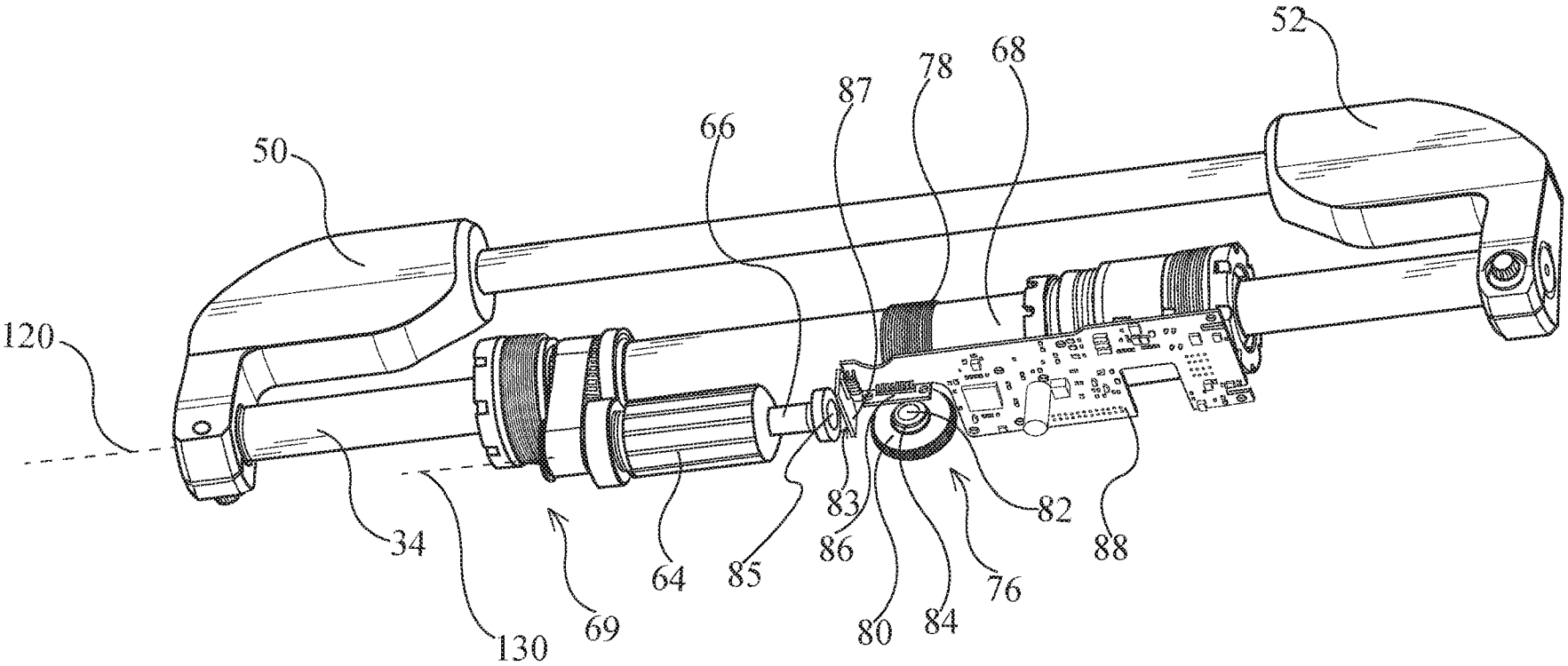
FIG. 8 is a fragmentary perspective view of the electric actuator showing an actuator position sensor thereof.

Referring now to FIG. 8, the electric actuator 30 also includes an actuator position sensor 76 for sensing an actual position of the rotor 68 of electric actuator 30. The actuator position sensor may be a rotary position sensor, or a linear position sensor with a helical magnetic element, or any other suitable sensor. The actuator position sensor 76 senses an absolute steering position and may be referred to as an absolute position sensor. The actuator position sensor employs a gear reduction which, in this example, is a worm-like. There is an outer threading 78 on the rotor 68 which engages a driven sensor gear 80. There is a magnet 82 disposed on the end of a shaft 84 which extends axially from the driven sensor gear 80. A position of the magnet 82 is sensed by a non-contact position sensor element 86.

There is also a motor position sensor 83, shown in FIG. 8, which senses a position of the motor 64, in this example a rotation position of the motor. The motor position sensor senses a relative steering position based on said position of the motor. The motor position sensor 83 may be a rotary position sensor, or a linear position sensor with a helical magnetic element, or any other suitable sensor. In this example, the motor position sensor 83 is rotary position sensor which includes a magnet 85 disposed on the output shaft 66 of the motor 64. A position of the magnet 85 is sensed by a non-contact position sensor element 87.

The actuator position sensor 76 is disposed along the longitudinal axis 120 of the output shaft 34 of the electric actuator. The motor position sensor 83 is disposed along the longitudinal axis 130 of the output shaft 66 of the motor 64. The absolute or actuator position sensor 76 and the relative or motor position sensor 83 are thus installed on two separate axes. The longitudinal axis 120 of the output shaft 34 and the longitudinal axis 130 of the output shaft 66 of the motor 64 are linked by the drive mechanism.

A steering control unit or controller 88 is disposed within the housing 32 of the electric actuator and reads the sensor element 86 as the actual steering position. The controller 88 also reads a steering command from the steering wheel 18, shown in FIG. 1, and then drives the motor 64 based on a difference between the steering command and the actual steering position. The controller 88 reads the sensor element 87 as the relative steering position. The controller 88 then calibrates the motor position sensor 83 based on a signal of the actuator position sensor 76 and the gear ratio relationship of the drive mechanism 69.

The controller 88 reads the actuator position signal from the actuator position sensor 76 on axis 120 of the actuator output shaft 34. It also reads of the accumulated motor position change from the relative/motor position sensor 83 on the motor (drivetrain input) axis 130. The controller 88 calibrates the relative/motor position sensor based on a signal of the absolute/actuator position sensor 76 and the gear ratio relationship among the drivetrain and gears.

Calibration of the relative/motor position sensor 83 based on a signal of the absolute/actuator position sensor 76 initializes a virtual position sensor which indicates a virtual steering position. The controller 88 may initialize the virtual position sensor when the electric actuator 30 is powered-up. The controller may combine a signal of the absolute/actuator position sensor 76 and a signal of the virtual position sensor to provide redundant signal. The controller 88 may also cross-reference a signal of the actuator position sensor signal and the virtual position sensor signal to monitor for mismatch of position sensor signals. If the absolute position sensor signal and virtual position sensor signal are both valid but mismatch, this will trigger a fault, and stop the electric actuator 30. The controller 88 can further analyse information from the actuator position sensor 76 and the motor position sensor 83. For example, if the actuator position sensor signal remains stationary while the motor position sensor signal is changing in the same rate and direction as the motor 64 rotates, this may indicate a possibility of a broken belt 70 of the drive mechanism 69, or a disconnection in the drive mechanism 69. Alternatively, if the signal mismatch only occurs every motor rotation, this may indicate a stripped tooth in the belt 70, but that the belt 70 is still functional. This information can be used to assist diagnostic and automatic electric actuator 30 fault handling to stop the electric actuator 30, or to run the electric actuator 30 in a reduced performance mode. The sensor design configuration of placing one absolute position sensor along the actuator output axis and a sensor 83 along the output shaft 66 of the motor 64 promotes both position sensor redundancy and abilities to troubleshoot actuator drive mechanism failure.

Figure 9:
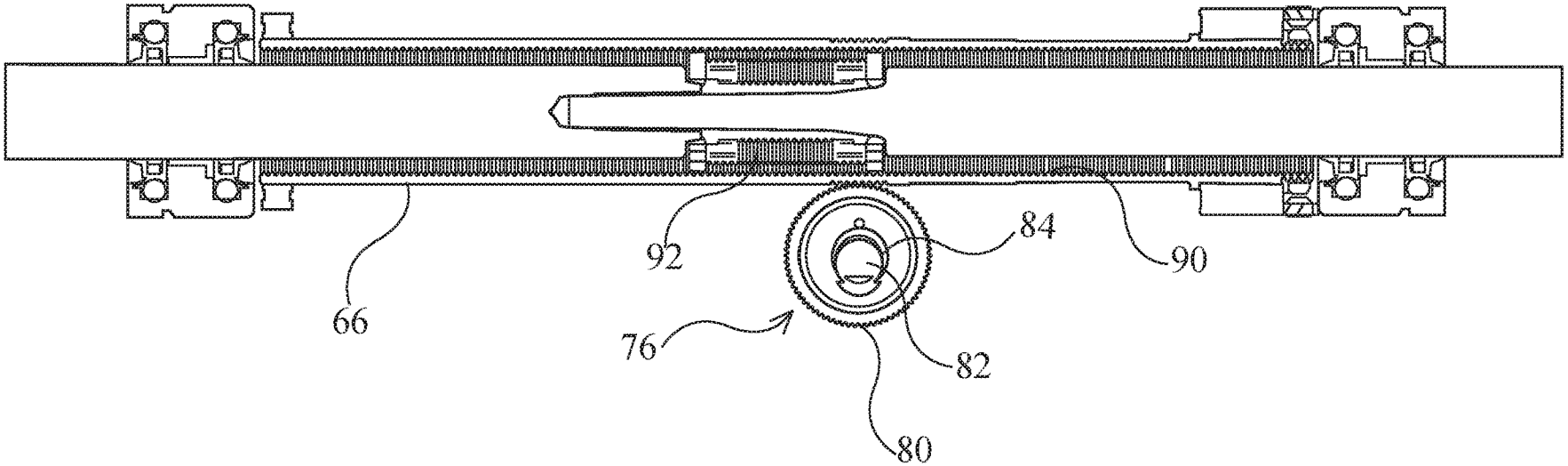
FIG. 9 is a fragmentary, sectional elevation view of the electric actuator showing the actuator position sensor thereof.

The rotor 68 also has inner threading 90 which is shown in FIG. 9. The inner threading 90 of the rotor 68 engages a roller screw assembly 92. The roller screw assembly is axially and rotationally inhibited by the support arms 50 and 52. It is possible to remove a nut at the support arms, for example nut 94 shown in FIG. 8, to manually reposition the housing. In this example, the lead of a roller screw assembly 92 of the electric actuator 30 is 0.1 inches, so for an 8.0 inch stroke, the rotor 68 of the electric actuator 30 turns approximately eighty times. A reduction gear of >80:1 is accordingly employed so the driven sensor gear 80 never rotates more than one rotation. Disposing the actuator position sensor 76 on the rotor 68 places the actuator position sensor 76 closer to the output of the electric actuator 30 to avoid fault.

Figure 10:
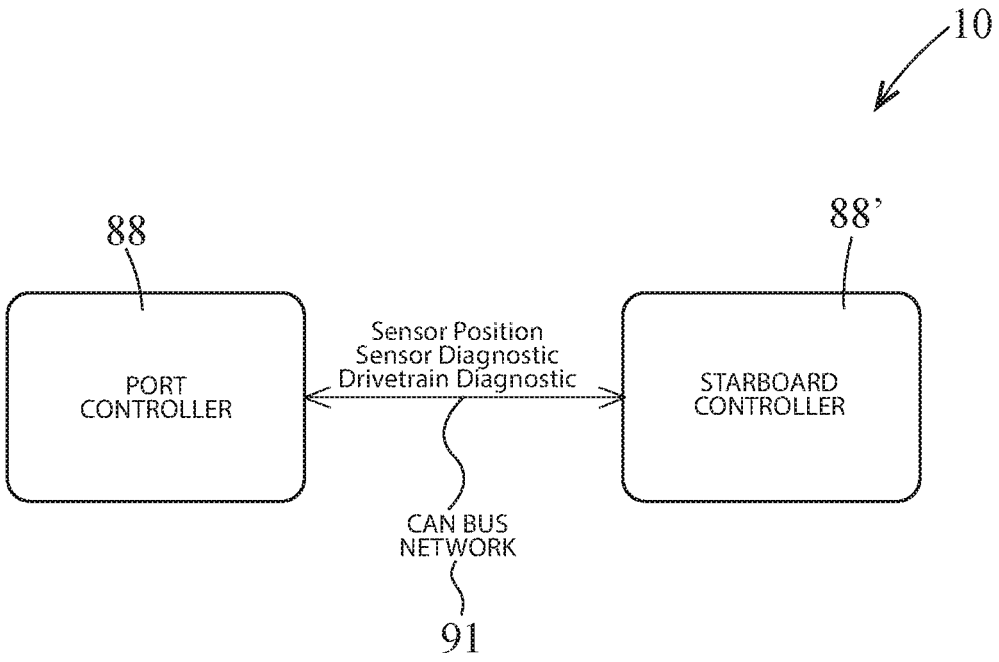
FIG. 10 is a flowchart showing communication between adjacent electronic actuators on a CAN network.

The marine vessel shown in FIG. 1 has multiple engines 12 and 14 and each of the engines has a respective electric actuator. Each electric actuator has a controller 88 and 88' as seen in FIG. 10, and each controller continuously communicates its sensor position as well as sensor and drive mechanism 69 self-diagnostic status to other controllers connected on a CAN bus network 91.

Figure 11:
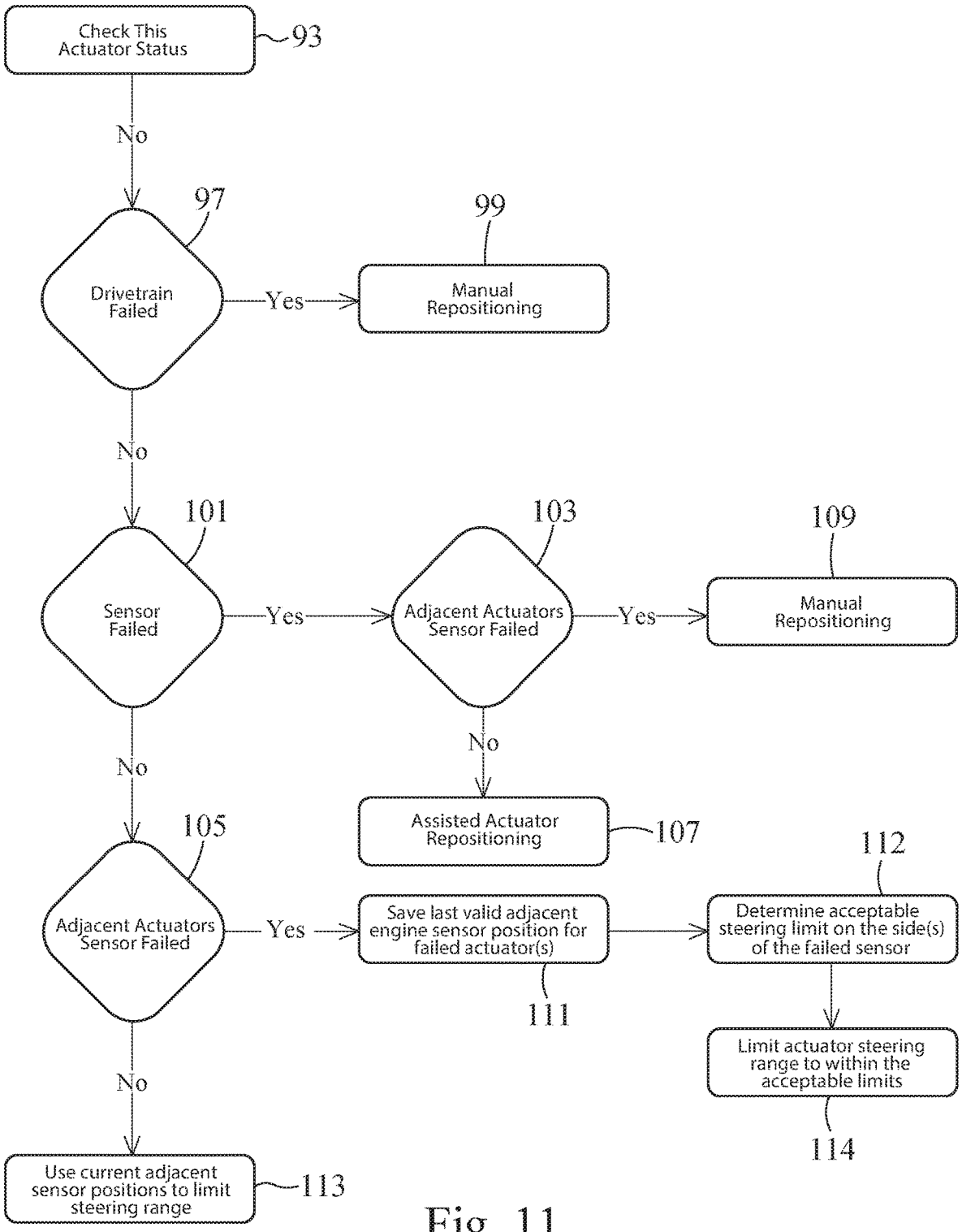
FIG. 11 is a flowchart showing the logic for repositioning and setting a limited steering range of a given electric actuator.
Figure 12:
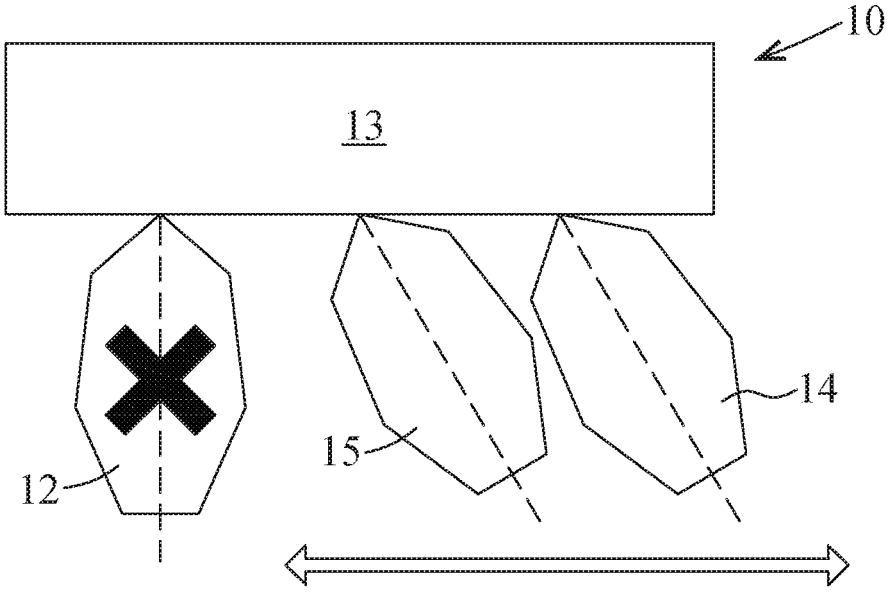
FIG. 12 is a simplified top plan view of the transom of the marine vessel of FIG. 1, with three propulsion units coupled thereto, with a port propulsion unit having drive mechanism failure.
Figure 13:
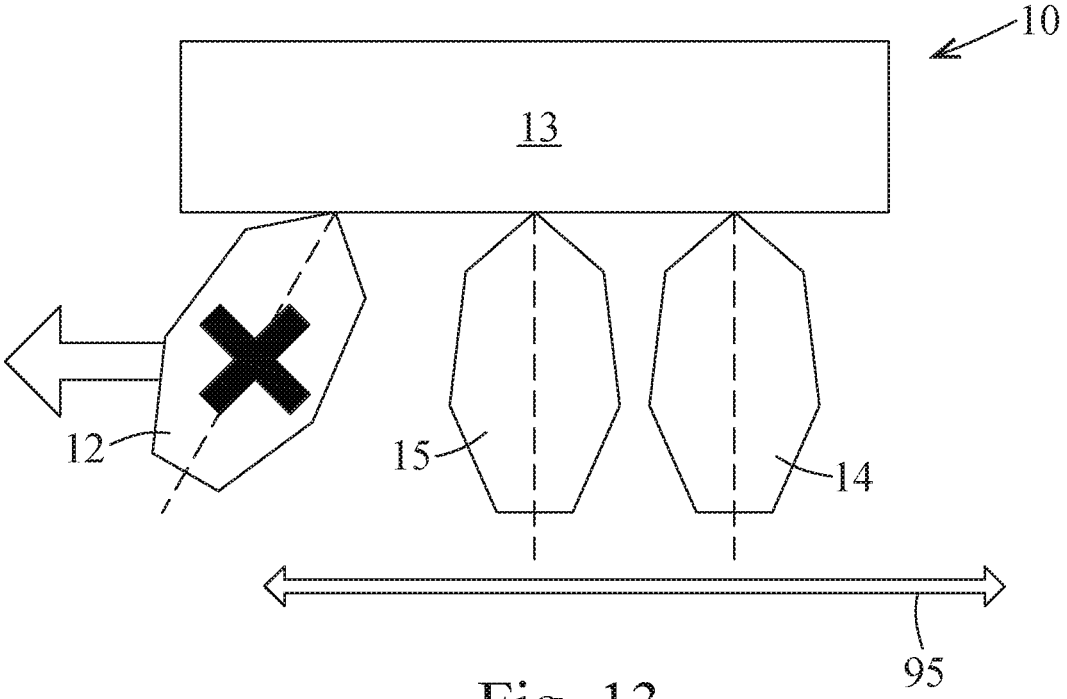
FIG. 13 is a simplified top plan view of the transom of the marine vessel of FIG. 12, with the port propulsion unit having electric actuator failure and being moved out of the way, and with the electric actuators of the other propulsion units automatically increase their steering range thereafter.

The steering range of each electric actuator depends on the sensor position and self-diagnostic status communicated by other controllers as shown in FIG. 11. An actuator status check is performed as shown by box of numeral 93. An electric actuator of propulsion unit 12 seen in FIG. 12 with drive mechanism failure, as seen shown by box of numeral 97, can be manually repositioned, as described above for the electric actuator 30 of FIG. 5, by rotating the output shaft 66 of the motor 64 or the output shaft 34 of the electric actuator 30. This step is shown in FIG. 11 by box of numeral 99. The controller 88 can continue to communicate its position to the controllers of the other electric actuators. If the failed electric actuator and corresponding propulsion unit 12 have been moved out of the way as seen in FIG. 13, the other electric actuators can automatically increase their steering range as shown by arrow of numeral 95 for starboard propulsion unit 14 and middle propulsion unit 15.

If the electric actuator 30 has a sensor failure but no drive mechanism 69 failure as shown by box of numeral 101 in FIG. 11, the controller 88 will first check its adjacent electric actuators' sensor signals and sensor self-diagnostic status as shown by boxes of numerals 103 and 105. If the adjacent electric actuators have functional sensors, the failed electric actuator can either automatically, or upon user confirmation, reposition itself to allow other electric actuators to have greater steering range. This is shown by box of numeral 107. If the actuator has not received a valid position sensor signal from an adjacent actuator, then the actuator will use the last known steering position of adjacent actuator to limit its steering range.

If adjacent electric actuators have non-functional sensors, then this electric actuator require manual repositioning as shown by box of numeral 109.

Where no sensor failure is detected but one or more adjacent actuator sensors have failed, the controller saves the last valid adjacent engine sensor position for the failed actuator, as shown by box of numeral 111. The actuator next determines an acceptable range of allowable steering, steering limit, for the side thereof in which the adjacent actuator has failed. This is shown by box 112 in FIG. 11.

If this electric actuator has received a valid sensor position from its adjacent electric actuator(s), then it allows normal steering up to the position limited by its adjacent electric actuator(s) to avoid engine collision. This is shown by box of numeral 113. The controller thereafter limits the actuator steering range to within this acceptable steering limit, as shown by box of numeral 114.

Figure 14:
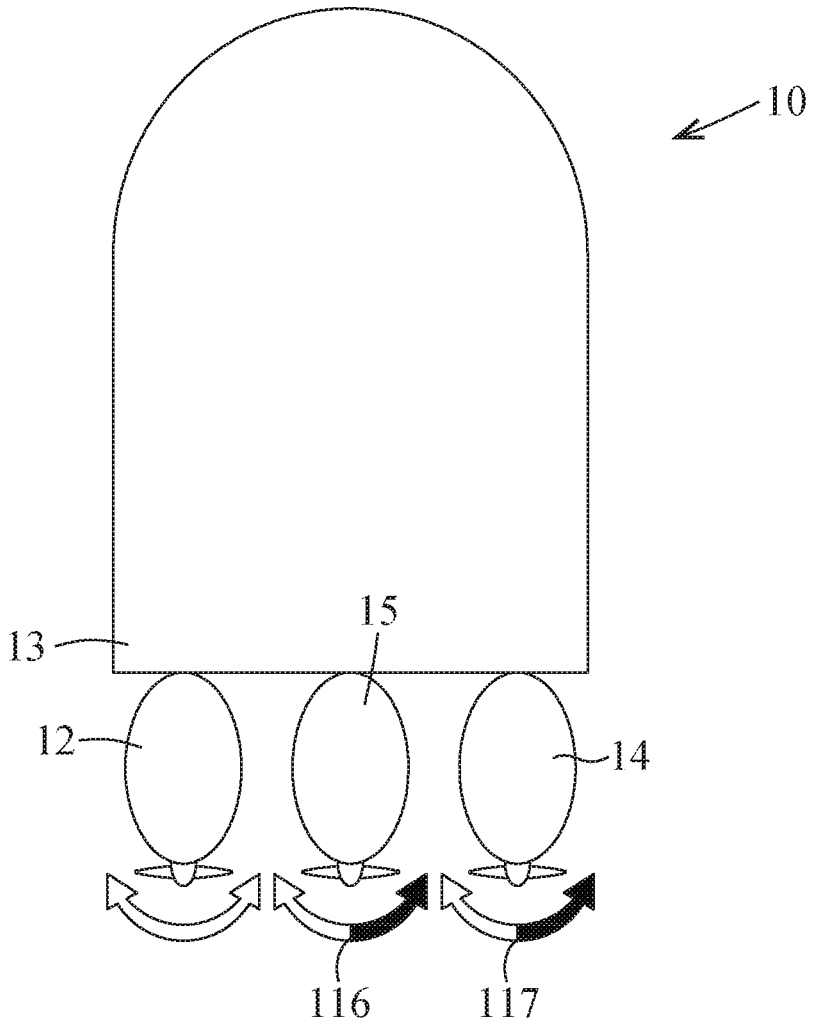
FIG. 14 is a simplified top plan view of the marine vessel of FIG. 1, with three propulsion units coupled thereto, with the port propulsion unit having a failed sensor and being in a straight-ahead position and with the steering limits of the other propulsion units being determined and shown in response thereto.

FIG. 14 shows an example of the port propulsion unit 12 having a failed sensor in its steering actuator in which the propulsion unit is in a straight-ahead position. The steering sensor and controller are housed within the electric or steering actuator which is connected to the propulsion unit. The controller of the steering actuator for the propulsion unit 15 detects the failed sensor and thus determines an acceptable steering limit 116 on the side of the failed sensor. The starboard propulsion unit 14 via the controller of its corresponding steering actuator detects that propulsion unit 15 has an actuator with a valid sensor but uses the sensor position of the actuator of the propulsion unit 15 to determine an acceptable steering limit 117 on the side adjacent to the actuator with the failed sensor. Collision between the propulsion units is inhibited thereby while still enabling the marine vessel 10 to have some steering ability and maneuverability.

Figure 15:
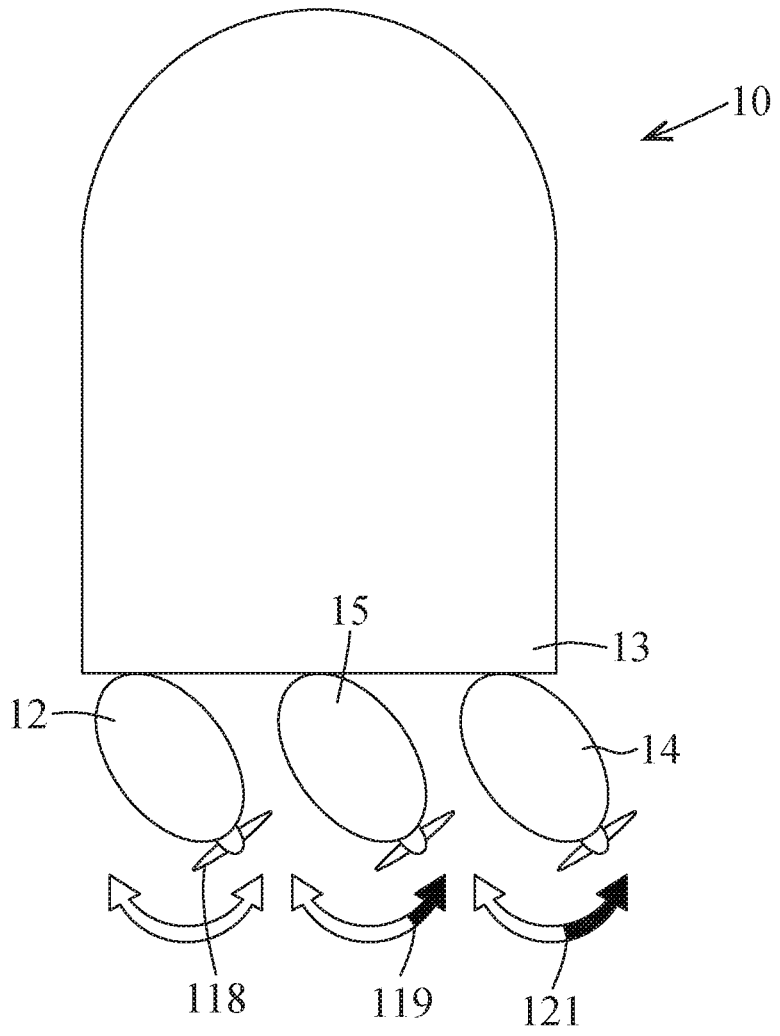
FIG. 15 is a simplified top plan view of the marine vessel of FIG. 1, with three propulsion units coupled thereto, with the port propulsion unit having a failed sensor and being positioned angled with the propeller thereof angled towards the middle propulsion unit, and with the steering limits of the other propulsion units being determined and shown in response thereto.

Similarly, FIG. 15 shows an example of the port propulsion unit 12 having a failed sensor in its steering actuator, where the port propulsion unit is angled with the propeller 118 thereof angled towards the middle propulsion unit 15. The controller of the steering actuator for the propulsion unit 15 detects the failed sensor in its steering actuator and thus determines an acceptable steering limit 119 on the side of the failed sensor. The starboard propulsion unit 14 via the controller of its corresponding steering actuator detects that the steering actuator of propulsion unit 15 has a valid position sensor signal but uses the sensor position of the steering actuator of the propulsion unit 15 to determine an acceptable steering limit 121 on the side of the actuator with the failed sensor. Collision between the propulsion units is inhibited thereby while still enabling the marine vessel 10 to have some steering ability and maneuverability.

Figure 16:
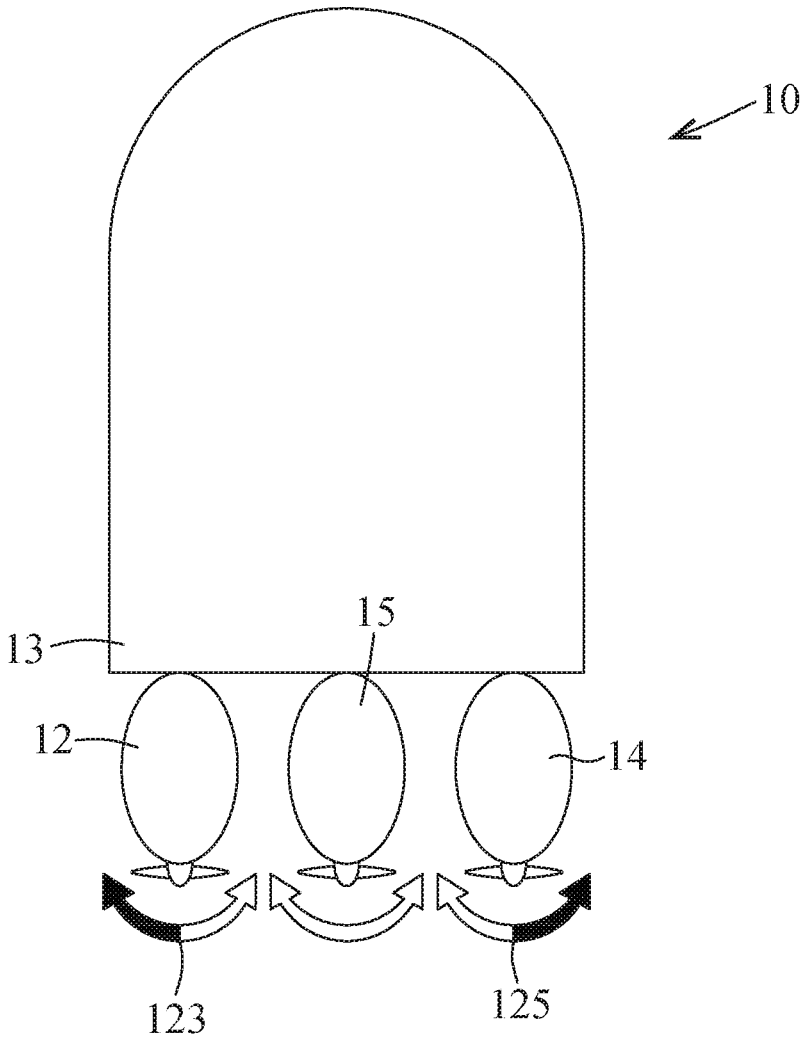
FIG. 16 is a simplified top plan view of the marine vessel of FIG. 1, with three propulsion units coupled thereto, with the middle propulsion unit having a failed sensor and being in a straight-ahead position and with the steering limits of the other propulsion units being determined and shown in response thereto.

FIG. 16 shows an example of the middle propulsion unit 15 having a failed sensor in its steering actuator, where the middle propulsion unit is in a straight-ahead position. The controller of the steering actuator for the port propulsion unit 12 detects the failed sensor and thus determines an acceptable steering limit 123 on the side of the failed sensor. The starboard propulsion unit 14 via the controller of its corresponding steering actuator detects that the steering actuator of propulsion unit 15 has a failed sensor and here too determines an acceptable steering limit 125 on the side adjacent to the propulsion unit 15. Collision between the propulsion units is inhibited thereby while still enabling the marine vessel 10 to have some steering ability and maneuverability.

Figure 17:
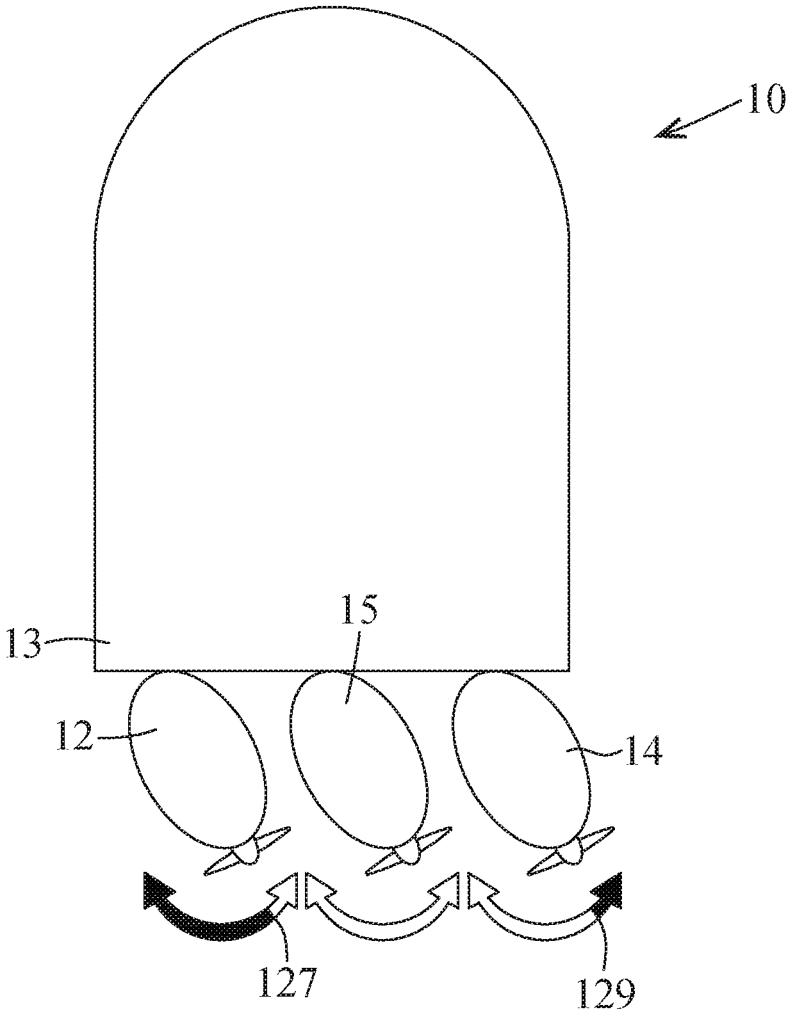
FIG. 17 is a simplified top plan view of the marine vessel of FIG. 1, with three propulsion units coupled thereto, with the middle propulsion unit having a failed sensor and being in an angled position and with the steering limits of the other propulsion units being determined and shown in response thereto.

FIG. 17 similarly shows an example of the middle propulsion unit 15 having a failed sensor in its steering actuator, where the middle propulsion unit is positioned angled to one side. The controller of the steering actuator of the port propulsion unit 12 detects the failed sensor and thus determines an acceptable steering limit 127 on the side of the failed sensor. The starboard propulsion unit 14 via the controller of its steering actuator detects that propulsion unit 15 has a failed sensor in its steering actuator and here too determines an acceptable steering limit 129 on the side adjacent to the propulsion unit 15. Collision between the propulsion units is inhibited thereby while still enabling the marine vessel 10 to have some steering ability and maneuverability.

The above may be referred to as a method to diagnose sensor failure and drive train mechanism in an electric actuator, and this information is shared across the network to allow other actuators to handle such failure in a system of multiple electric actuators. This method enhances system availability by providing limited range steering and assisted repositioning in corresponding failure scenarios.

In a traditional hydraulic power assist steering system with multiple propulsion units, the steering actuators are connected together with a physical tie bar or tie bars. The tie bar is used as a way to tie the steering motion of all propulsion units, and prevent engine collision. However, in such a traditional system, it may not be possible to provide partial steering capability in the event of power steering failure and manual repositioning is required.

In contrast, the system and methods as herein described may comprise a well-developed 'partial steering' system utilizing coordination of multiple controllers and sensors for multi-engine marine steering application.

In a traditional hydraulic power steering system, as for example disclosed in United States Patent Application Publication No. 2015/0034001A1, the disclosure of which is incorporated herein by reference, the hydraulic cylinders are not mechanically coupled to the hydraulic pumps. Each steering actuator is individually and independently calibrated, with the other engines moved out of the way before calibration and purging of air out of hydraulic hoses. This is to prevent engine collision while the engine being calibrated moves to its two hard stops.

Figure 18:
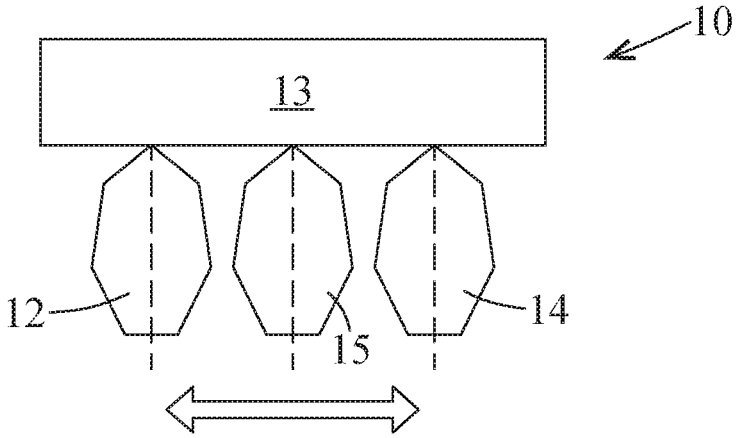
FIG. 18 is a simplified top plan view of the transom of the marine vessel of FIG. 1, with three propulsion units coupled thereto and being shown in straight-ahead positions.
Figure 19:
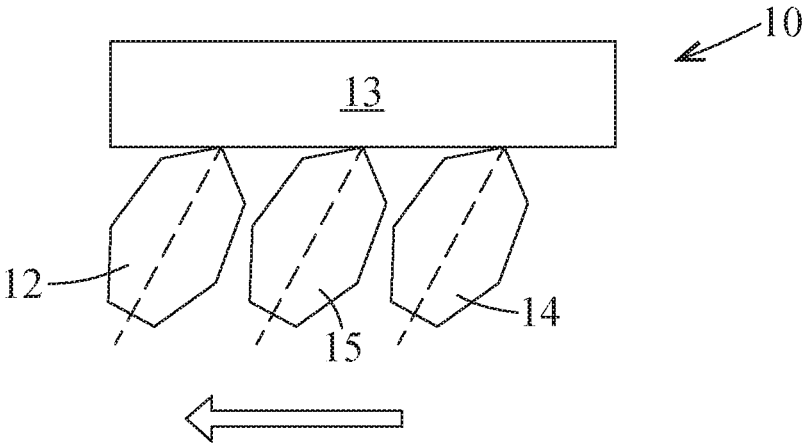
FIG. 19 is a simplified top plan view of the transom of the marine vessel of FIG. 1, with three propulsion units coupled thereto and being shown angled to a first side.
Figure 20:
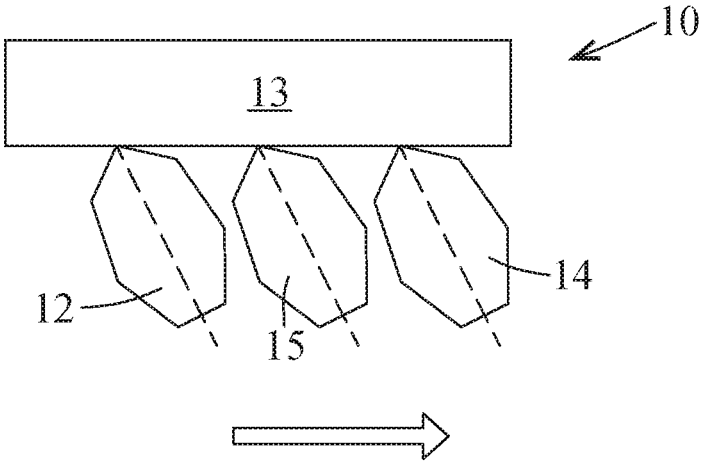
FIG. 20 is a simplified top plan view of the transom of the marine vessel of FIG. 1, with three propulsion units coupled thereto and being shown angled to a second side.

A hard stop calibration allows the controller 88 to learn its functional steering range to account for installation tolerance, physical hard stops in engines, or spacers installed on the steering output shaft. This method allows preliminary rough position calibration to be done at the factory, and simultaneous, fine calibration of multiple engines to be done in the field. The electric actuators are mechanically coupled to the steering output shaft, and can run through a rough pre-calibration in the factory. This rough calibration is enough to prevent engine collision during slow steering movements. The actuators can then move in unison, as seen in FIGS. 18 to 20, when calibrating the hard stops of a marine vessel. This greatly improves the speed and simplicity of calibration.

Figure 21:
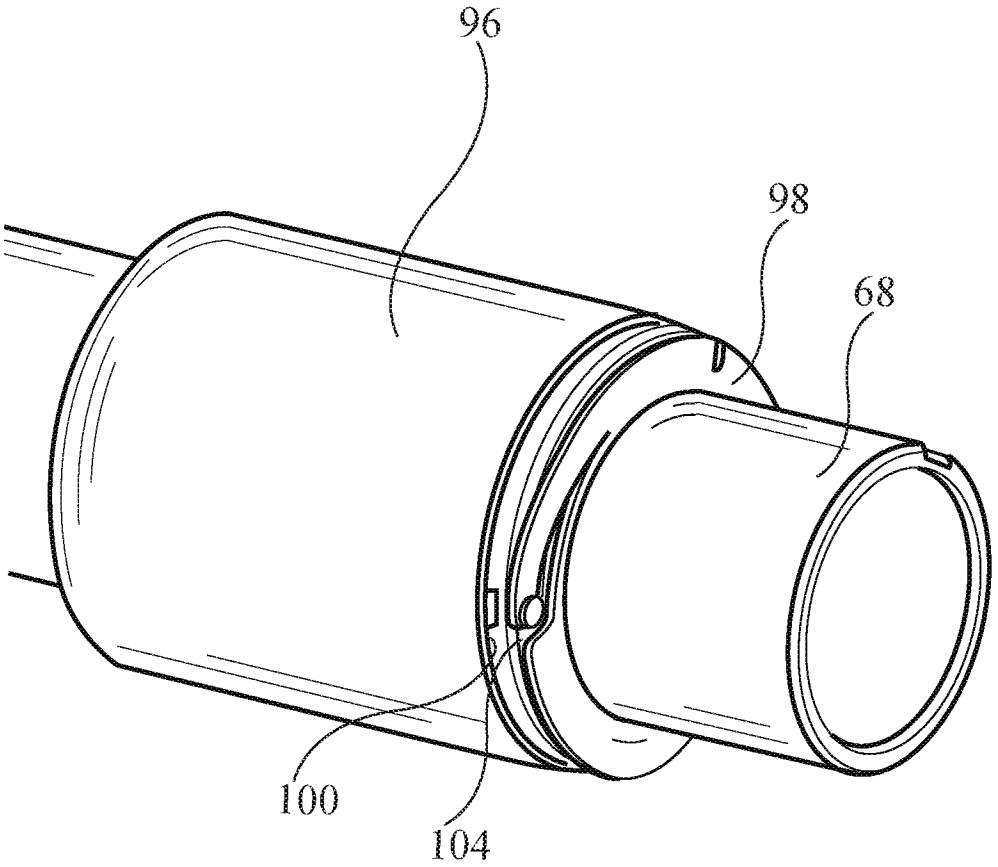
FIG. 21 is a fragmentary perspective view of the electric actuator showing a brake thereof.
Figure 22:
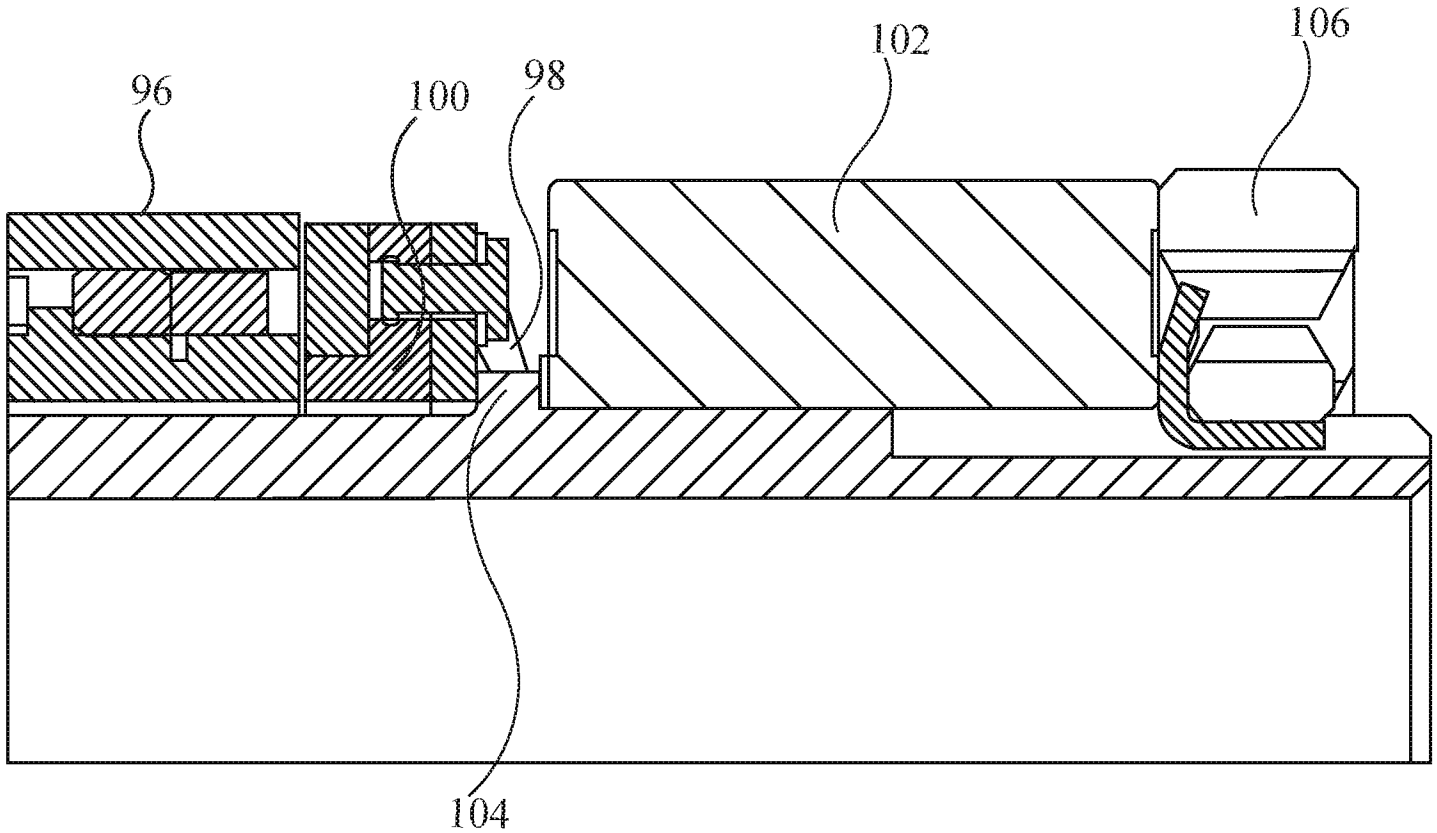
FIG. 22 is a fragmentary sectional view of the electric actuator showing the brake thereof.

The electric actuator 30 also includes a clutch 96, which may function as a brake, which is coaxial to the rotor 68 and shown in FIGS. 21 and 22. The clutch 96 is generally similar to the clutch disclosed in International Patent Application Publication No. WO/2016/004532 in the name of Davidson et al. However, in this example, there is a flexure 98 directly coupled to the rotor 68 without a hub. The flexure 98 pulls back a brake pad 100 when the clutch 96 is released and the flexure 98 transmits torque from the rotor 68 when the clutch 96 is engaged. There is a bearing 102 which clamps the flexure 98 against a flange 104 on the rotor 68 of the electric actuator 30. There is also a lock nut 106 which allows the clutch 96 to be manually released.

Figure 24:
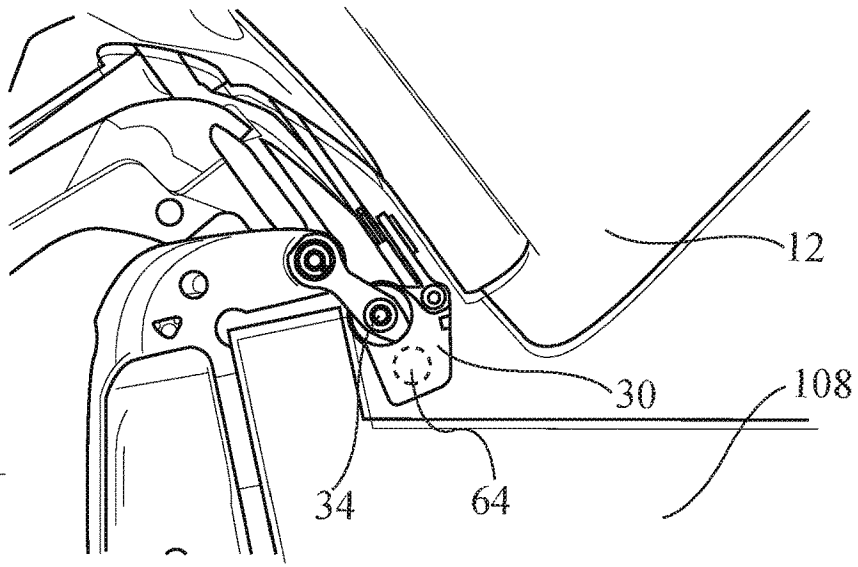
FIG. 24 is a side elevation view showing a disposition of the electric actuator when the propulsion unit is tilted up.
Figure 23:
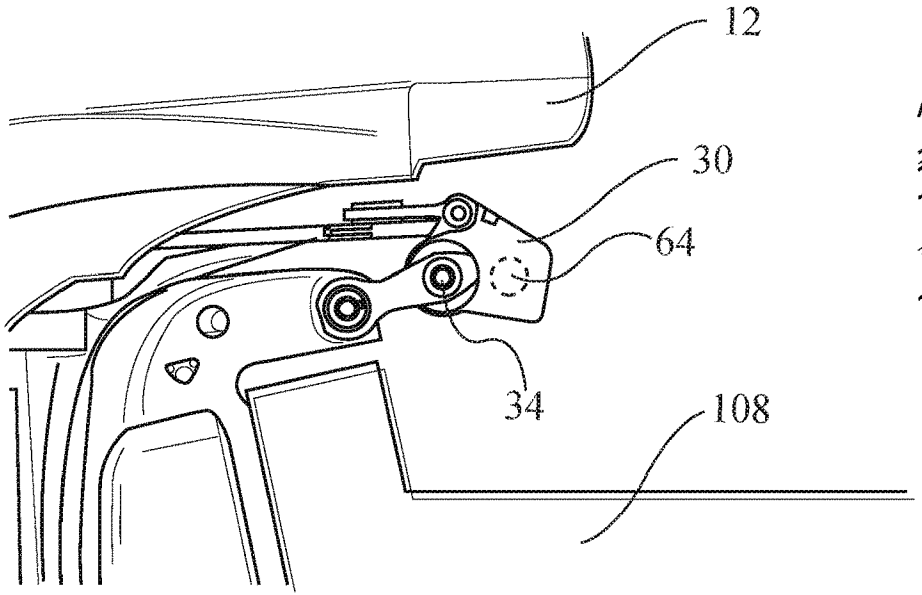
FIG. 23 is a side elevation view showing a disposition of the electric actuator when the propulsion unit is tilted down.

The electric actuator 30 has an envelope such that the motor 64 of the electric actuator 30 is disposed, relative to the marine vessel 10, in front of the output shaft 34 of the electric actuator 30 in the tilted down position and the tilted up position, and all tilt positions therebetween, as shown in FIGS. 23 and 24. The motor 64 of the electric actuator 30 is also disposed under the port propulsion unit 12 and above a splashwell 108 of the marine vessel in the tilted down position and the tilted up position, and all tilt positions therebetween, as shown in FIGS. 23 and 24. The housing of the electric actuator is pivotable when the propulsion unit is pivotable.

Figure 25:
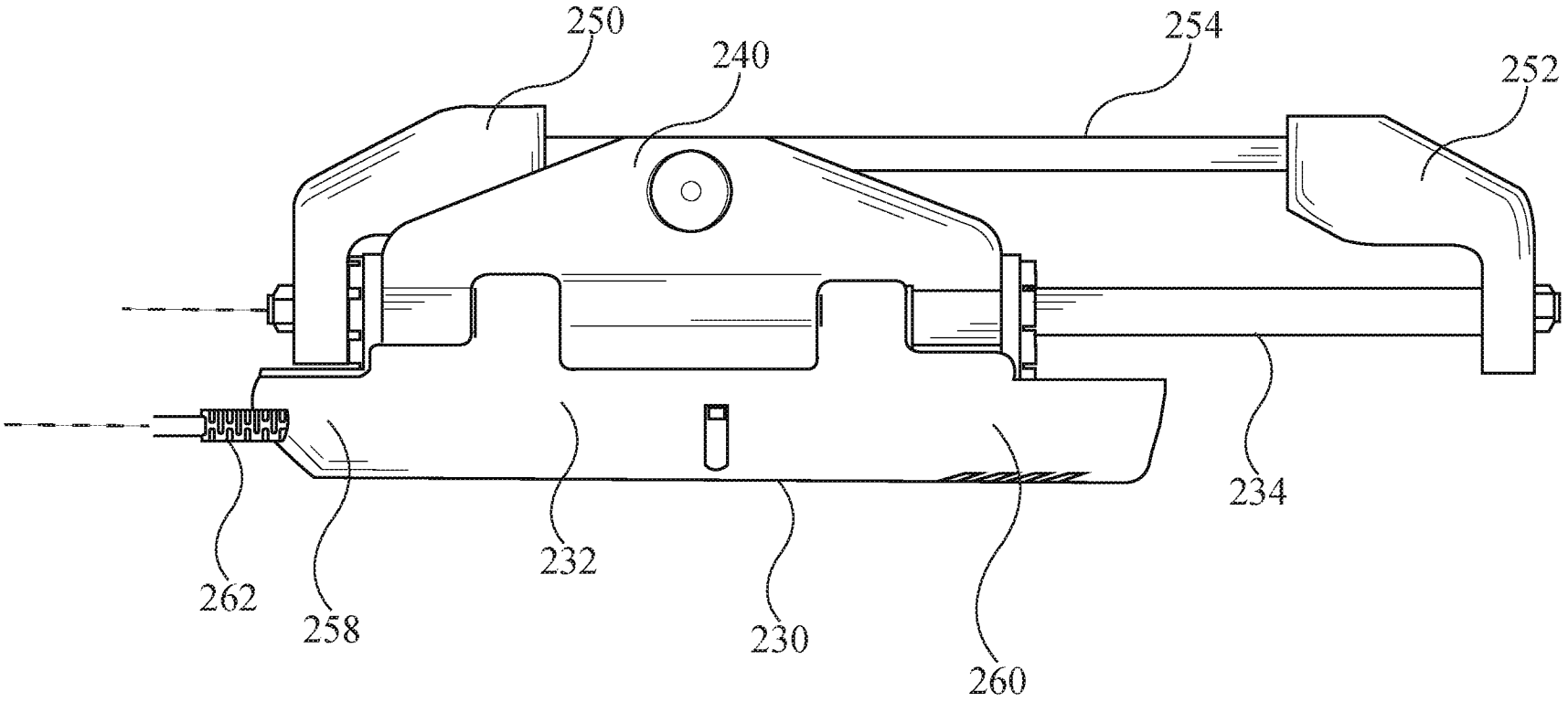
FIG. 25 is a top plan view of another electric actuator.
Figure 26:
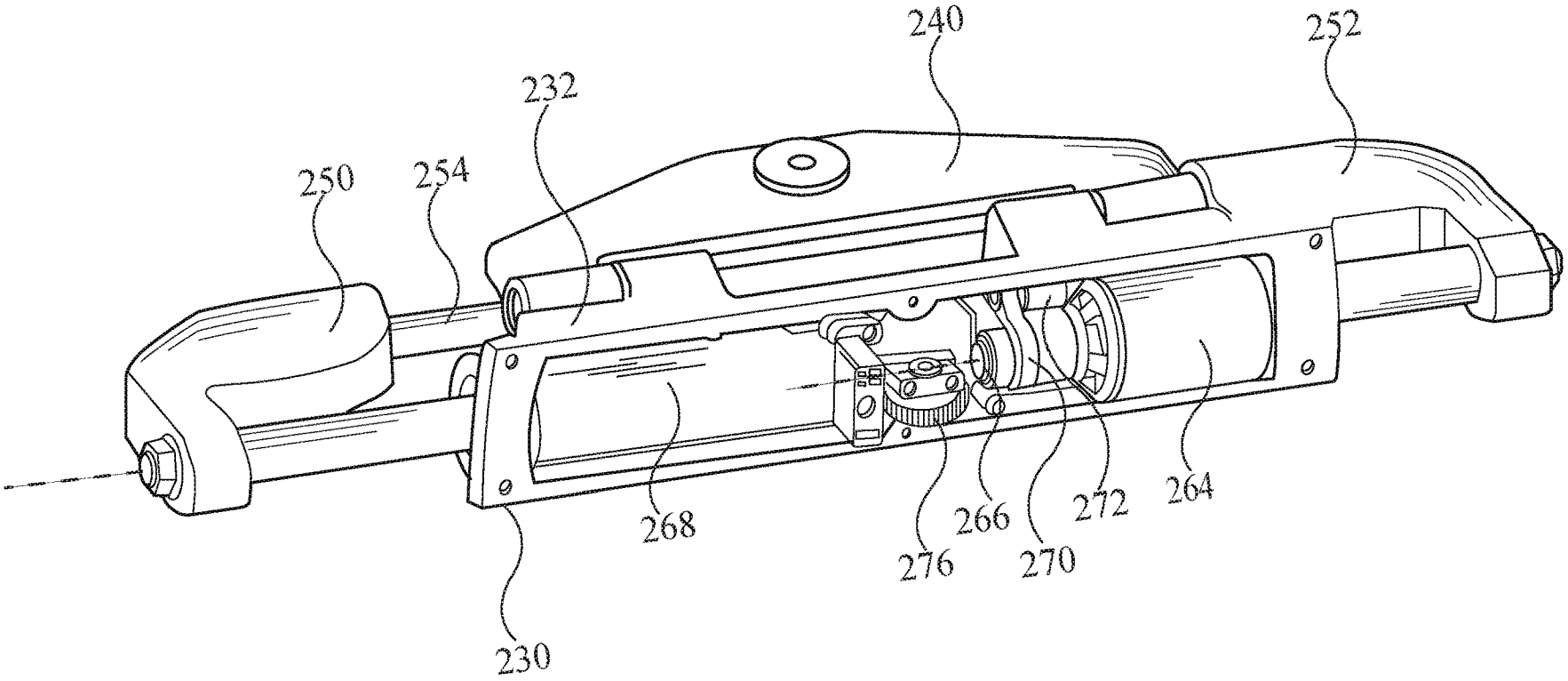
FIG. 26 is a partly broken away view of the electric actuator of FIG. 25.
Figure 27:
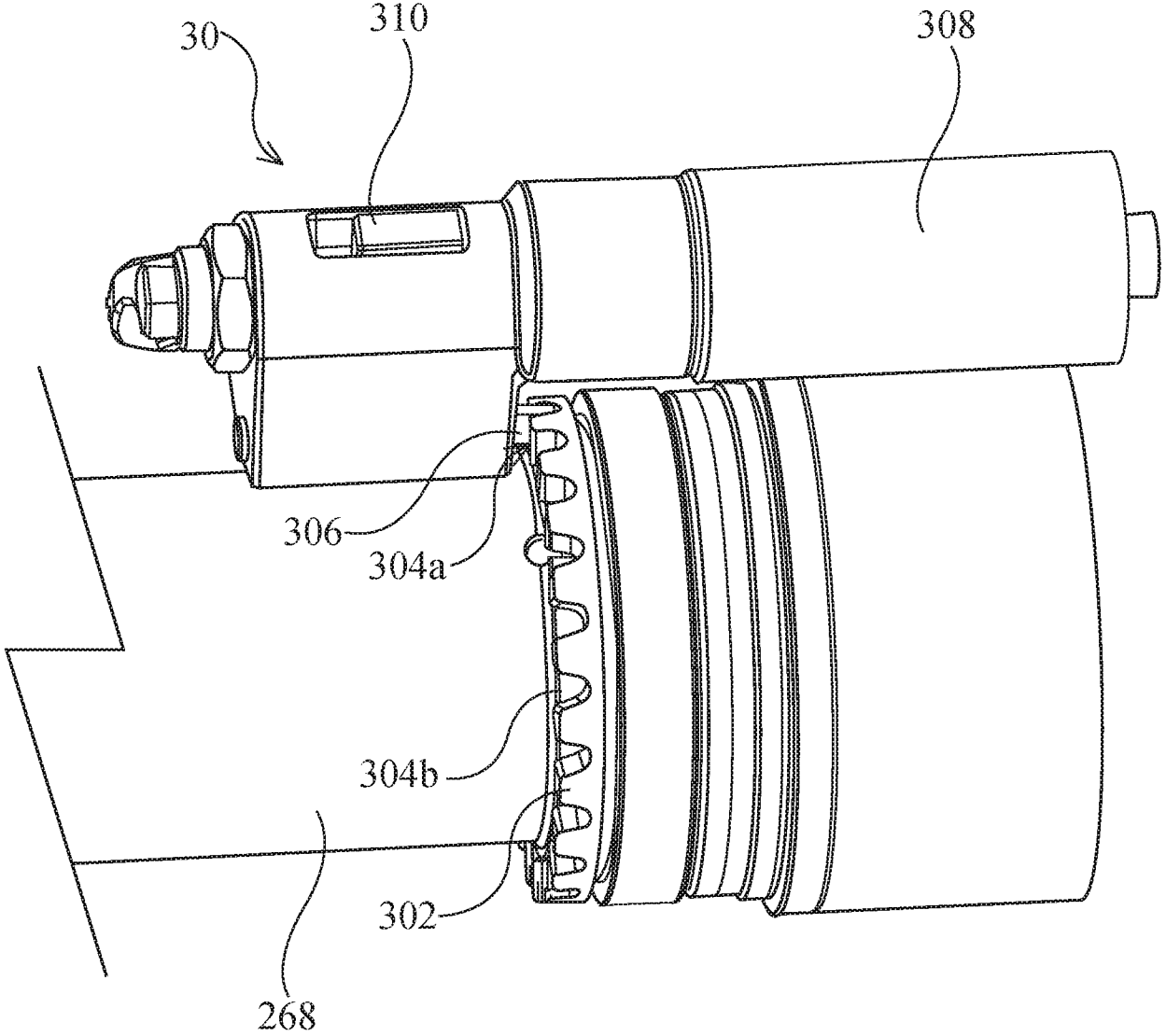
FIG. 27 is a fragmentary perspective view of the electric actuator of FIG. 25 showing a brake thereof in the engaged position.
Figure 28:
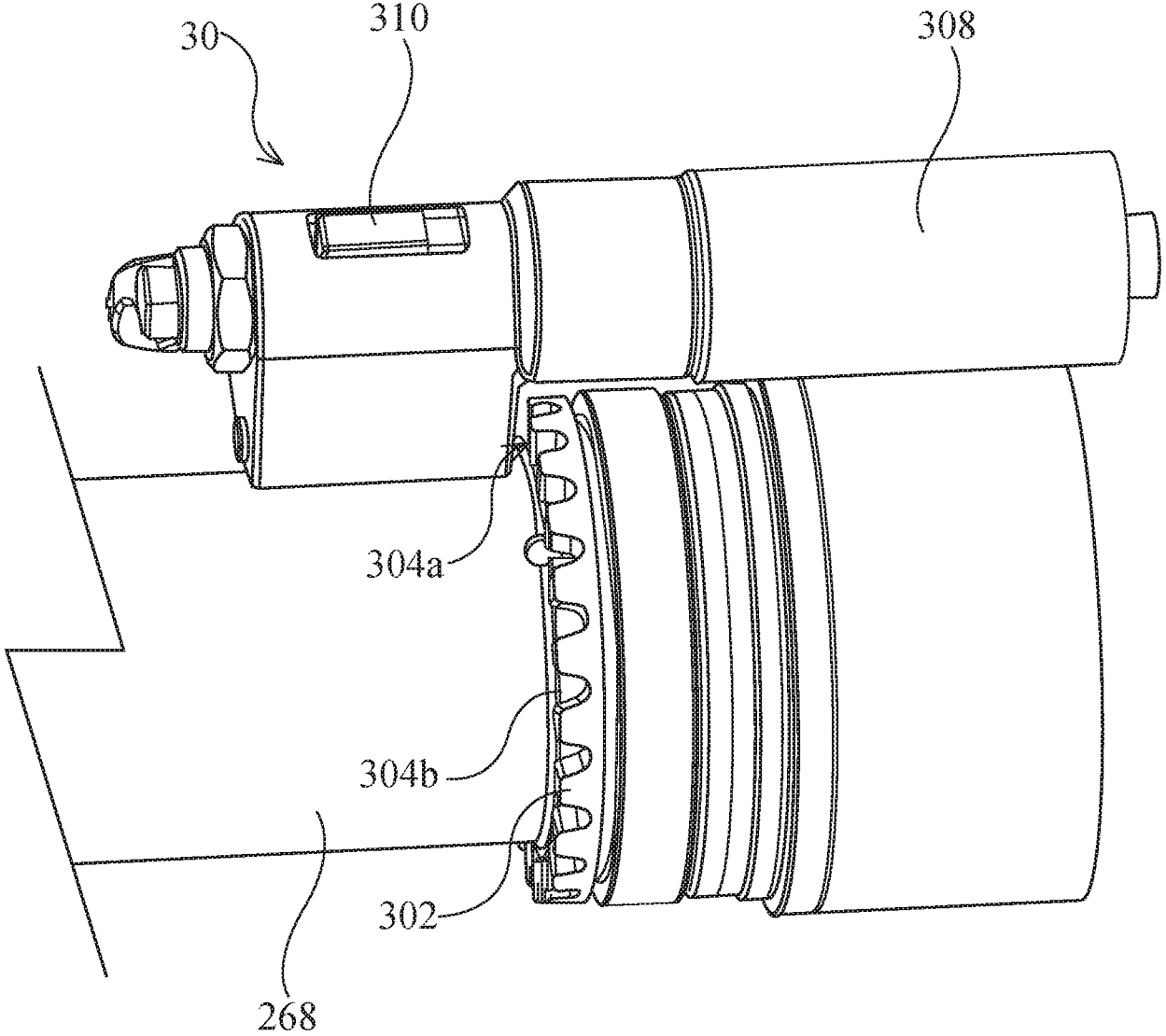
FIG. 28 is a fragmentary perspective view of the electric actuator of FIG. 25 showing the brake thereof in the released position.

Another electric actuator 230 is shown in FIGS. 25 and 26. The electric actuator 230 is generally similar to the actuator 30, as shown in FIGS. 4 and 5, with the following notable exceptions. The electric actuator 230 shown in FIGS. 25 and 26 is a mirror image of the electric actuator 30, shown in FIGS. 4 and 5, with like parts given like reference numerals in the 200 series. Furthermore, the electric actuator 230 is provided with a brake 300 which is shown in FIGS. 27 and 28. The brake 300 includes a brake pad 302 secured to the rotor 268. The brake pad 302 is generally annular and is circumambient to the rotor 268. The brake pad 302 has a plurality of radial openings, for example, radial openings 304*a* and 304*b*.

The brake 300 is in an engaged position when a pin 306 engages one of said radial openings, for example, said radial opening 304*a* as shown in FIG. 27. The brake 300 is provided with a solenoid 308 which, when de-energized and as shown in FIG. 27, allows the brake to be in the engaged position with a pin 306 engaging one of said radial openings 304*a*. A biased slider 310 is coupled to the pin 306 and biases the pin 306 to engage one of said radial openings 304*a*. However, when the solenoid 308 is energized, the slider 310 is pushed away from the brake pad 302 and the pin 306 disengages from the brake pad 302, as shown in FIG. 27, when the brake is in the released position. Accordingly, when the electric actuator 230 is not powered the brake 300 is in the engaged position. This prevents the electric actuator 230 from being back driven. When the electric actuator is powered then the brake 300 is released to allow steering. The slider 310 allows for manual override by a user.

It will be understood by a person skilled in the art that many of the details provided above are by way of example only, and are not intended to limit the scope of the invention which is to be determined with reference to the following claims.

What is claimed is:

1. A method of defining an actuator steering boundary on a marine vessel, the method comprising:

determining if a sensor of a first actuator of a first propulsion unit of the marine vessel has failed; and if so, using a last known position of the first said actuator to define a steering boundary of allowable steering of a second actuator of a second propulsion unit of the marine vessel to inhibit propulsion unit collision.

2. The method as claimed in claim 1 wherein the second said actuator is adjacent to the first said actuator.

3. The method as claimed in claim 1 further including after determining that the sensor of the first said actuator has failed:

if the second said actuator is between the first said actuator and a third said actuator of a third said propulsion unit of the marine vessel, using positioning of the third said actuator to further define the steering boundary of allowable steering of the second said actuator.

4. The method as claimed in claim 3 further including:

using positioning of the second said actuator to define a steering boundary of allowable steering of the third said actuator.

5. The method as claimed in claim 1 further including within determining that the sensor of the first said actuator has failed:

if a third said actuator of a third said propulsion unit of the marine vessel is adjacent to the first said actuator, using the last known position of the first said actuator to define a steering boundary of allowable steering of the third said actuator.

6. A method of defining a steering boundary of an actuator of a first propulsion unit mounted on a marine vessel, the marine vessel including at least one of a second propulsion unit having an actuator and a third propulsion unit having an actuator, the method comprising:

determining if a sensor of the actuator of a first of the second propulsion unit and the third propulsion unit has failed; and if so, using a last known position of the actuator of the first of the second propulsion unit and the third propulsion unit to define a steering boundary of allowable steering of the actuator of the first propulsion unit to avoid propulsion unit collision.

7. The method as claimed in claim 6, further comprising:

determining if a sensor of the actuator of a second of the second propulsion unit and the third propulsion unit has failed; and if so, using a last known position of the actuator of the second propulsion unit and the third propulsion unit to further define the steering boundary of allowable steering of the actuator of the first propulsion unit to avoid propulsion unit collision if the first propulsion unit is between the second propulsion unit and the third propulsion unit.

8. A method of defining one or more steering boundaries of one or more actuators on a marine vessel, the marine vessel including a plurality of propulsion units with each said propulsion unit having a respective said actuator, the method comprising:

determining if a sensor of one said actuator has failed; and if so, using a last known position of the one said actuator to define one or more steering boundaries of allowable steering of one or more other said actuators to inhibit propulsion unit collision.

9. The method as claimed in claim 8 wherein the one or more other said actuators comprise one or more said actuators which are adjacent to the one said actuator that has failed.

10. The method as claimed in claim 8 wherein the one said actuator having the failed sensor comprises the actuator of a first of a port said propulsion unit and a starboard said propulsion unit, and the one or more other said actuators comprise the actuator of at least one said propulsion unit between the port said propulsion unit and the starboard said propulsion unit.

11. The method as claimed in claim 8 wherein the one said actuator having the failed sensor comprises the actuator of a first of a port said propulsion unit and a starboard said propulsion unit, and the one or more other said actuators comprise the actuator of a second of the port said propulsion unit and the starboard said propulsion unit.

12. The method as claimed in claim 11 wherein the one or more other said actuators further comprise the actuator of at least one said propulsion unit between the port said propulsion unit and the starboard said propulsion unit.

13. A method of maintaining steering ability and inhibiting propulsion unit collision for a marine vessel, the marine vessel including a plurality of propulsion units with each said propulsion unit having a respective actuator, and the method comprising:

determining if a sensor of one said actuator has failed;

if so, using a last known position of the one said actuator to define a steering boundary of allowable steering of one or more other said actuators to inhibit propulsion unit collision; and using the one or more said propulsion units of the one or more other said actuators to maintain steering ability of the vessel.

14. The method as claimed in claim 13 wherein the one or more other said actuators comprise one or more said actuators which are adjacent to the one said actuator that has failed.

15. The method as claimed in claim 1, further including:

providing each said actuator with a position said sensor thereon to determine positioning thereof.

16. The method as claimed in claim 1, wherein said sensor comprises an actuator position sensor, wherein each said actuator includes an output shaft, and the method further including:

providing each said actuator with its actuator position sensor along a longitudinal axis of the output shaft thereof, each said actuator position sensor sensing an actual steering position.

17. The method as claimed in claim 1, wherein said sensor comprises a motor position sensor, wherein each said actuator includes a motor having an output shaft, and the method further including:

providing each said actuator with its motor position sensor along the output shaft of the motor thereof, the motor position sensor sensing a relative steering position based on a position of the motor.

18. A method of improving steering when a sensor of an actuator of a first of a plurality of propulsion units of the marine vessel has failed, the method comprising:

determining whether a drive mechanism of the actuator of the first said propulsion unit has failed;

if no, determining whether the actuator of a second said propulsion unit has a functional sensor;

if yes, repositioning the first said propulsion unit with the failed sensor to promote an improved steering range for the actuator of the second said propulsion unit.

19. The method as claimed in claim 18, the method further including:

determining that the drive mechanism of the actuator of the first said propulsion unit has failed by comparing an actuator position sensor signal of the actuator of the first said propulsion unit with a motor position signal of a motor of the actuator of the first said propulsion unit.

20. The method as claimed in claim 18, wherein each said actuator includes a controller, and the method includes:

each said controller continuously communicating an actuator sensor position thereof as well as sensor and self-diagnostic status information to other said controllers.

21. The method as claimed in claim 20, wherein each said controller communicates to the other said controllers via a CAN bus network.

22. The method as claimed in claim 18, further including:

determining the steering range of each said actuator based on sensor position and self-diagnostic statuses communicated by the other said controllers.

23. A method of detecting drive mechanism failure in an electric actuator of a propulsion unit for a marine vessel, the method including:

providing the electric actuator with a rotor, wherein rotation of the rotor causes an output shaft of the electric actuator to reciprocate;

providing the electric actuator with a motor having an output shaft, wherein a longitudinal axis of the output shaft of the electric actuator is parallel with a longitudinal axis of the output shaft of the motor;

providing the electric actuator with a drive mechanism coupling the output shaft of the motor to the rotor;

providing the electric actuator with an actuator position sensor along the longitudinal axis of the output shaft of the electric actuator, the actuator position sensor sensing an actual steering position;

providing the electric actuator with a motor position sensor along the output shaft of the motor, the motor position sensor sensing a relative steering position based on a rotating position of the motor; and comparing an actuator position sensor signal and a motor position signal to determine drive mechanism failure.

24. The method according to claim 23 further including providing motorized repositioning of the electric actuator when drive failure mechanism is determined.

25. The method according to claim 23 further including providing manual repositioning of the electric actuator when drive failure mechanism is determined.

26. A method of detecting drive mechanism failure in an electric actuator of a propulsion unit for a marine vessel, the electric actuator including an output shaft, a rotor rotation thereof causing the output shaft to reciprocate, a motor with an output shaft, and a drive mechanism coupling the output shaft of the motor to the rotor, the method including:

providing an actuator position sensor along the output shaft of the electric actuator, the actuator position sensor sensing an actual steering position;

providing a motor position sensor along the output shaft of the motor, the motor position sensor sensing a relative steering position based on a rotating position of the motor; and comparing an actuator position sensor signal and a motor position signal to determine drive mechanism failure.

27. The method as claimed in claim 26, wherein the actuator position sensor is positioned along a longitudinal axis of the output shaft of the electric actuator.

28. The method as claimed in claim 25, the method including:

determining that drive mechanism failure has occurred if the actuator position sensor signal remains stationary while the motor position sensor signal is changing in rate and direction as the motor rotates.

* * * * *